US011261806B1

(12) United States Patent
McConville

(10) Patent No.: US 11,261,806 B1
(45) Date of Patent: Mar. 1, 2022

(54) CAMSHAFT ASSEMBLY FOR CONTROLLING AIR FLOW

(71) Applicant: Ford Global Technologies, LLC, Dearborn, MI (US)

(72) Inventor: Gregory McConville, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/177,971

(22) Filed: Feb. 17, 2021

(51) Int. Cl.
*F02D 17/02* (2006.01)
*F02D 13/02* (2006.01)

(52) U.S. Cl.
CPC ..... *F02D 17/02* (2013.01); *F02D 13/0219* (2013.01)

(58) Field of Classification Search
CPC ..... F02D 17/02; F02D 13/0219
See application file for complete search history.

(56) References Cited

U.S. PATENT DOCUMENTS 7,287,499 B2 10/2007 Lawrence et al.
7,930,087 B2 4/2011 Gibson et al.
8,146,551 B2 4/2012 Pluta
2001/0004884 A1* 6/2001 Tachibana ..... F01L 1/34 123/90.15
2015/0087462 A1* 3/2015 Muller ..... F16H 1/32 475/162
2017/0114728 A1* 4/2017 Kosaka ..... F01L 1/344
2019/0316497 A1* 10/2019 Kakuda ..... F01L 1/344
2020/0018251 A1 1/2020 Kromrey et al.
2020/0088116 A1* 3/2020 McCarthy, Jr. ..... F02D 13/0261
2021/0270194 A1* 9/2021 Kozaki ..... F02D 41/0235

FOREIGN PATENT DOCUMENTS

WO 2009067789 A1 6/2009

* cited by examiner

*Primary Examiner* — George C Jin
(74) *Attorney, Agent, or Firm* — Geoffrey Brumbaugh; McCoy Russell LLP

(57) ABSTRACT

Methods and systems are provided for reducing air flow to an emission control device during a fuel shut-off event. In one example, a method may include adjusting a timing of an exhaust valve and a timing of an intake valve of a cylinder during the fuel shut-off event using a common actuator. The actuator may include a planetary gear system configured to rotate a first portion of a camshaft in a first direction and a second portion of the camshaft in a second, opposite direction.

20 Claims, 11 Drawing Sheets

CAMSHAFT ASSEMBLY FOR CONTROLLING AIR FLOW

FIELD

The present description relates generally to methods and systems for controlling a vehicle engine to increase fuel efficiency and reduce emissions.

BACKGROUND/SUMMARY

Contemporary vehicles may be adapted with technologies to increase fuel efficiency. As an example, during certain operating conditions such as deceleration fuel shut-off (DFSO), fuel flow to an engine may be halted to reduce fuel consumption. When DFSO is implemented, one or more fuel injectors may be deactivated during vehicle deceleration (e.g., reduced depression of an accelerator pedal resulting in a decrease in vehicle speed) or braking. By maintaining transmission engagement, the engine may run at a more efficient operating point during DFSO. Upon detecting increased depression of the accelerator pedal or when the vehicle reaches a threshold low speed, fuel flow may be resumed, thus enabling uninterrupted engine operation while circumventing consumption of fuel that does not provide useful power output.

However, engine operation without fuel injection at one or more cylinders may lead to delivery of fresh air to an exhaust aftertreatment system of the vehicle. The oxygen-rich air may accumulate in, for example, a three-way catalyst of the aftertreatment system which may degrade a capacity of the catalyst to treat exhaust gases. Fuel may be injected at the cylinders after a fuel shut-off event, such as DFSO, to compensate for the high oxygen levels stored at the catalyst. As such, some of the fuel savings provided by the fuel shut-off event may be offset by the additional fuel consumption after the event. Another undesired impact of using DFSO is that fresh air passing through the catalyst reduces the temperature of the catalyst, which may further reduce conversion efficiency.

Attempts to address reduced catalyst efficiency resulting from fuel shut-off events include adjusting a timing of a cylinder intake valve opening. One example approach is shown by Kromrey et al. in U.S. 2020/0018251. Therein, at least one cylinder of an engine is deactivated when a deceleration event is detected and an intake valve of the cylinder is closed. A signal is sent to a valve assembly, the valve assembly including the intake valve, to delay opening of the intake valve after the cylinder is re-activated. By delaying the opening of the intake valve, less air is drawn into the cylinder after re-activation which mitigates output of excessive torque upon exiting a fuel-shut off event. As a result, emission compliance and a fuel economy of a vehicle is improved.

However, the inventors herein have recognized potential issues with such systems. As one example, by halting air flow through the cylinder during the fuel shut-off event, a turbulence in the cylinder may be reduced. Upon re-activation, a likelihood of engine misfire and poor performance is increased which may lead to degradation of engine components and driver dissatisfaction.

In one example, the issues described above may be addressed by a method for a vehicle, including adjusting a timing of an exhaust valve and a timing of an intake valve of a cylinder during a fuel shut-off event using a common actuator, the common actuator including a planetary gear system configured to rotate a first portion of a camshaft in a first direction and a second portion of the camshaft in a second, opposite direction, wherein the first portion and the second portion of the camshaft are concentric. In this way, air flow to the catalyst may be reduced while maintaining a fuel efficiency of the vehicle.

As one example, one of the exhaust valve and the intake valve may be coupled to the first portion of the camshaft via a first set of cam lobes while the other of the exhaust valve and the intake valve may be coupled to the second portion of the camshaft via a second set of cam lobes. By rotating the first and second portions of the camshaft in opposite directions, first set of cam lobes and the second set of cam lobes are similarly rotated in opposite directions and the timing of the exhaust valve opening and intake valve opening may be varied. The actuator may further include a phasing mechanism configured to rotate a sun gear relative to a carrier of the planetary gear system, thereby allowing the planetary gear system to adjust phasing of the camshaft. As such, the timing of exhaust and intake valves may be adjusted to provide a zero or near-zero net flow of air to an emission control device of the vehicle during the fuel shut-off event.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-5 and 11 are shown approximately to scale.

DETAILED DESCRIPTION

Figure 1:
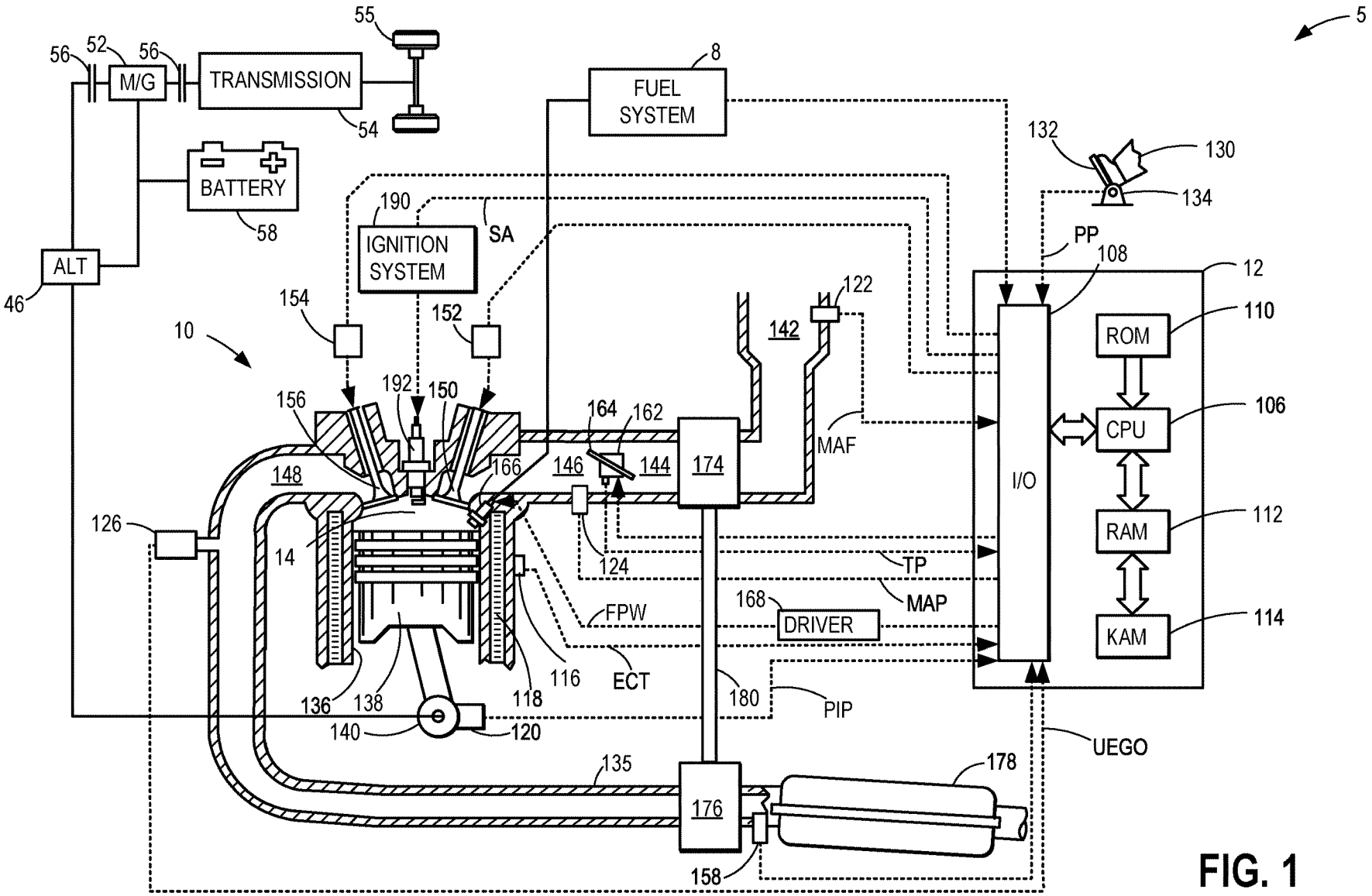
FIG. 1 shows an example of an engine system including an emission control device arranged in an exhaust system coupled to an engine.
Figure 2:
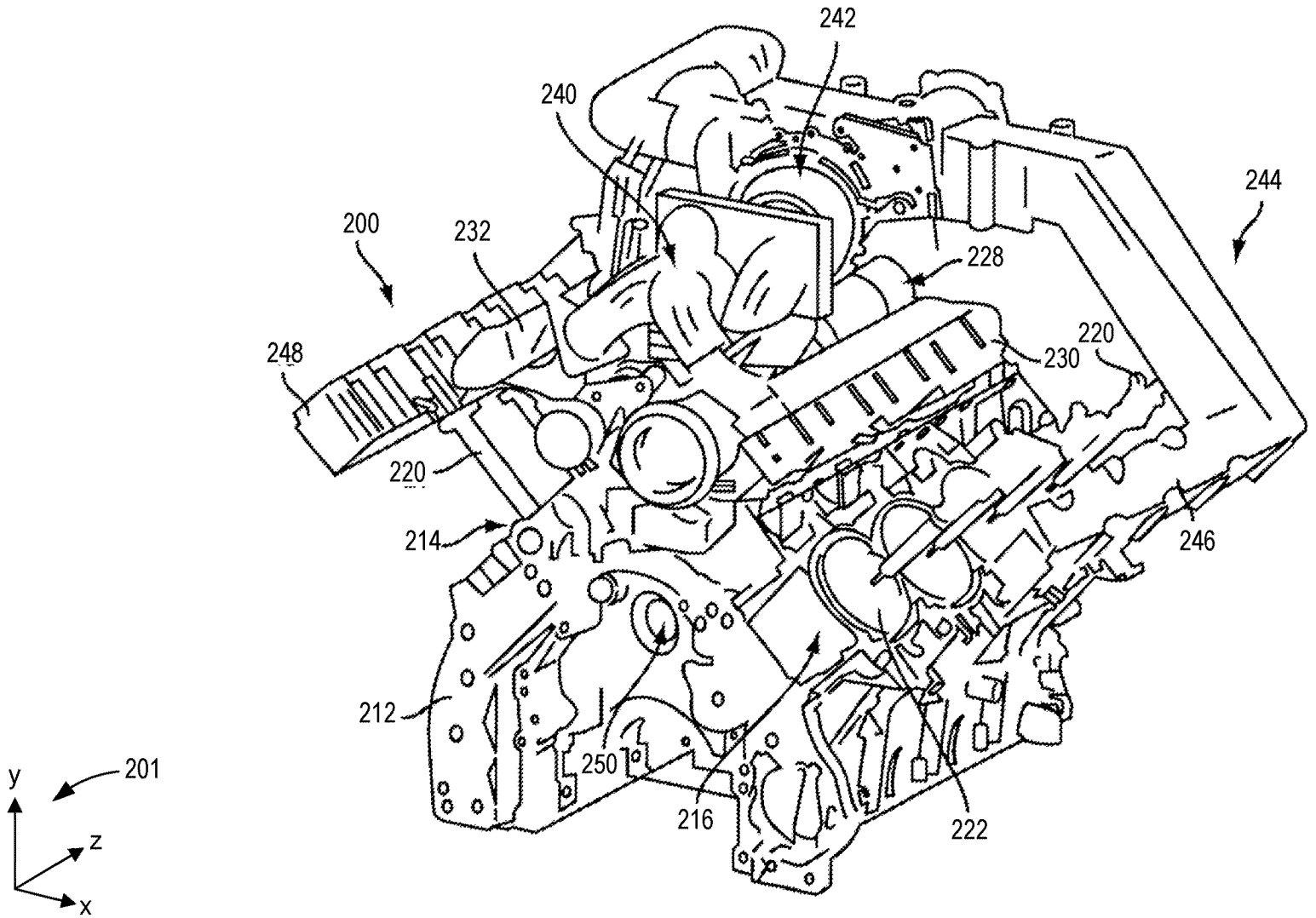
FIG. 2 shows an exemplary embodiment of the engine of FIG. 1 at which a cam assembly may be implemented to modify cam phasing during a fuel shut-off event.
Figure 3:
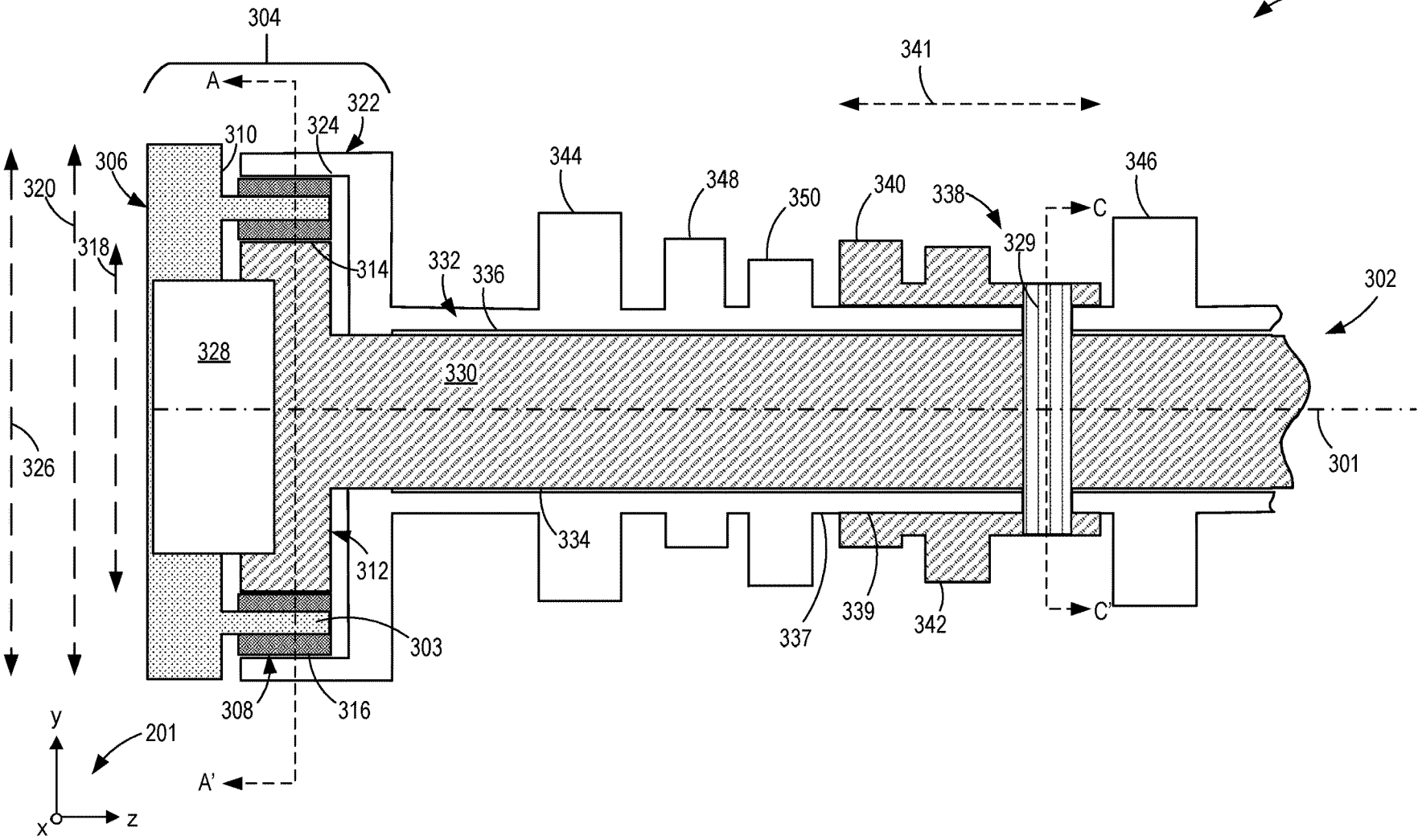
FIG. 3 shows a cross-sectional view of a first example of the camshaft assembly.
Figure 4:
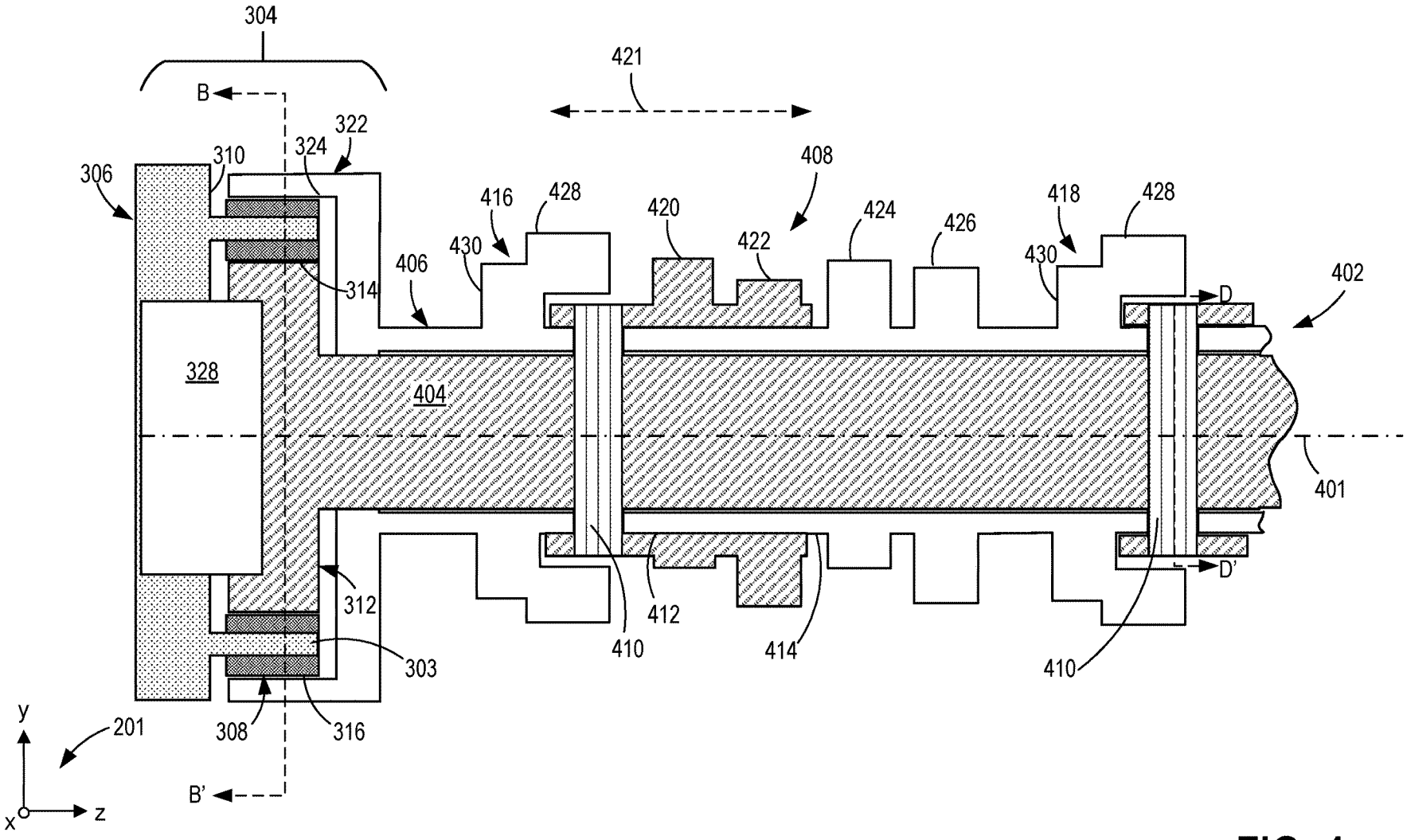
FIG. 4 shows a cross-sectional view of a second example of the camshaft assembly.
Figure 5:
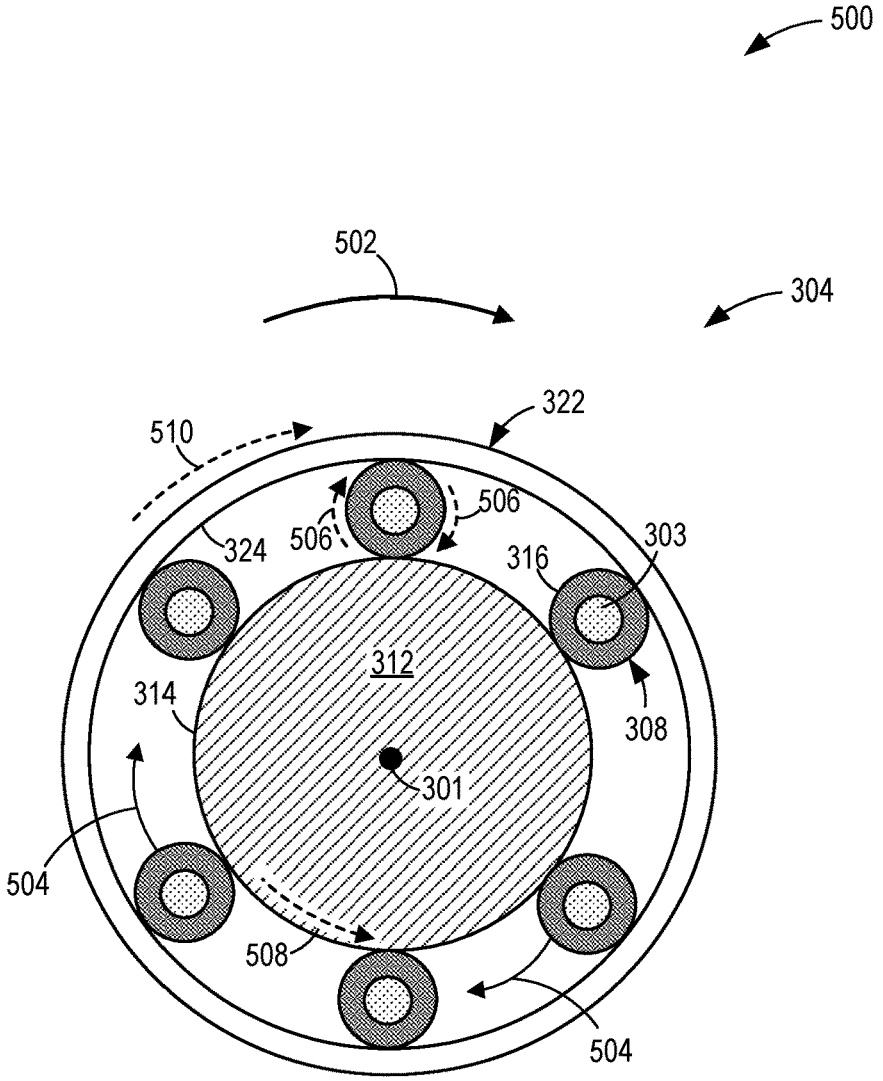
FIG. 5 shows a first cross-section of the camshaft assemblies of FIGS. 3 and 4.
Figure 5:
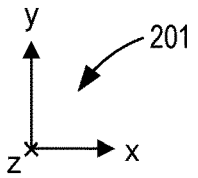
Figure 7:
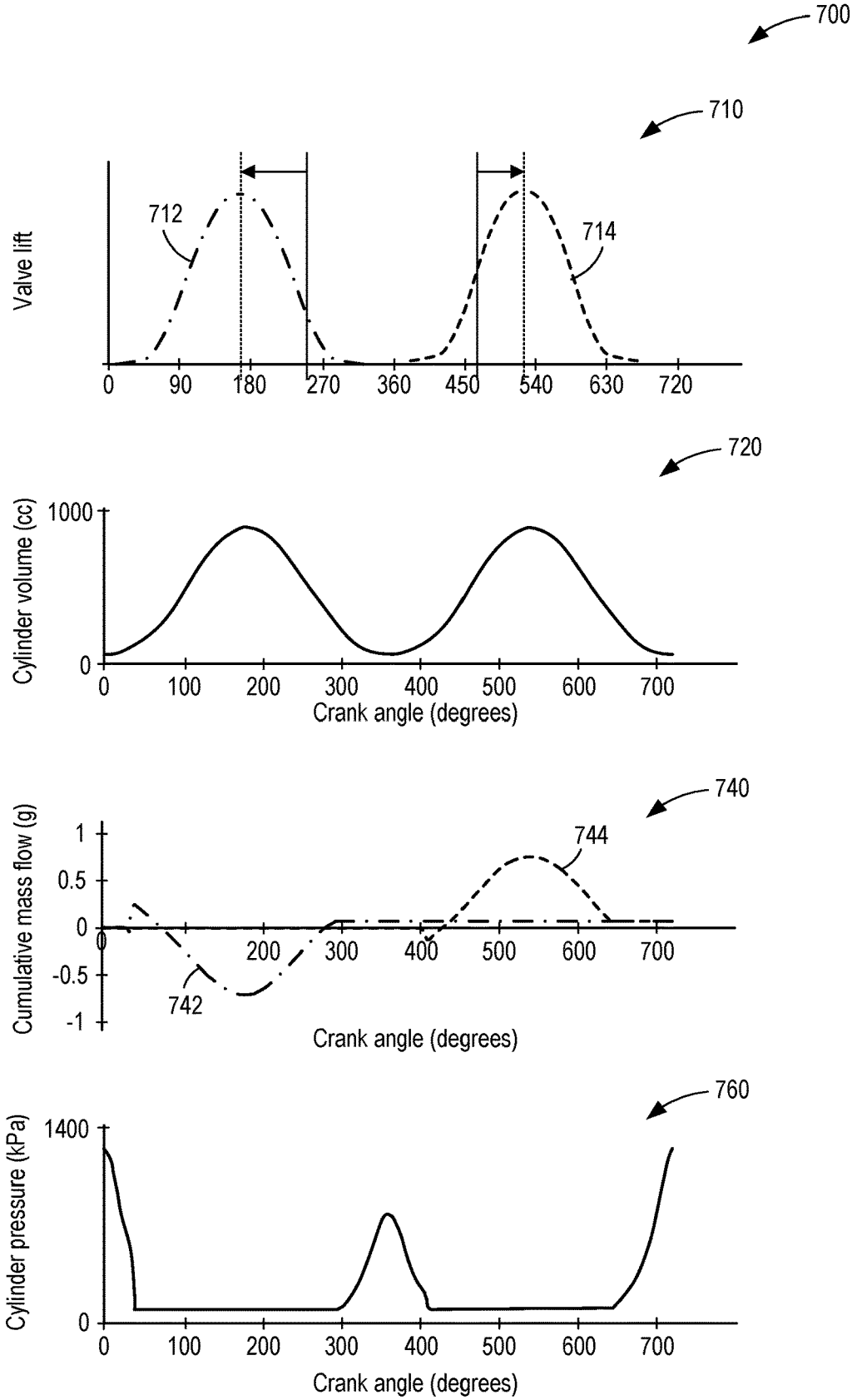
FIG. 7 shows a second set of graphs representing a cam phasing corresponding to the camshaft assembly of FIG. 3.
Figure 8:
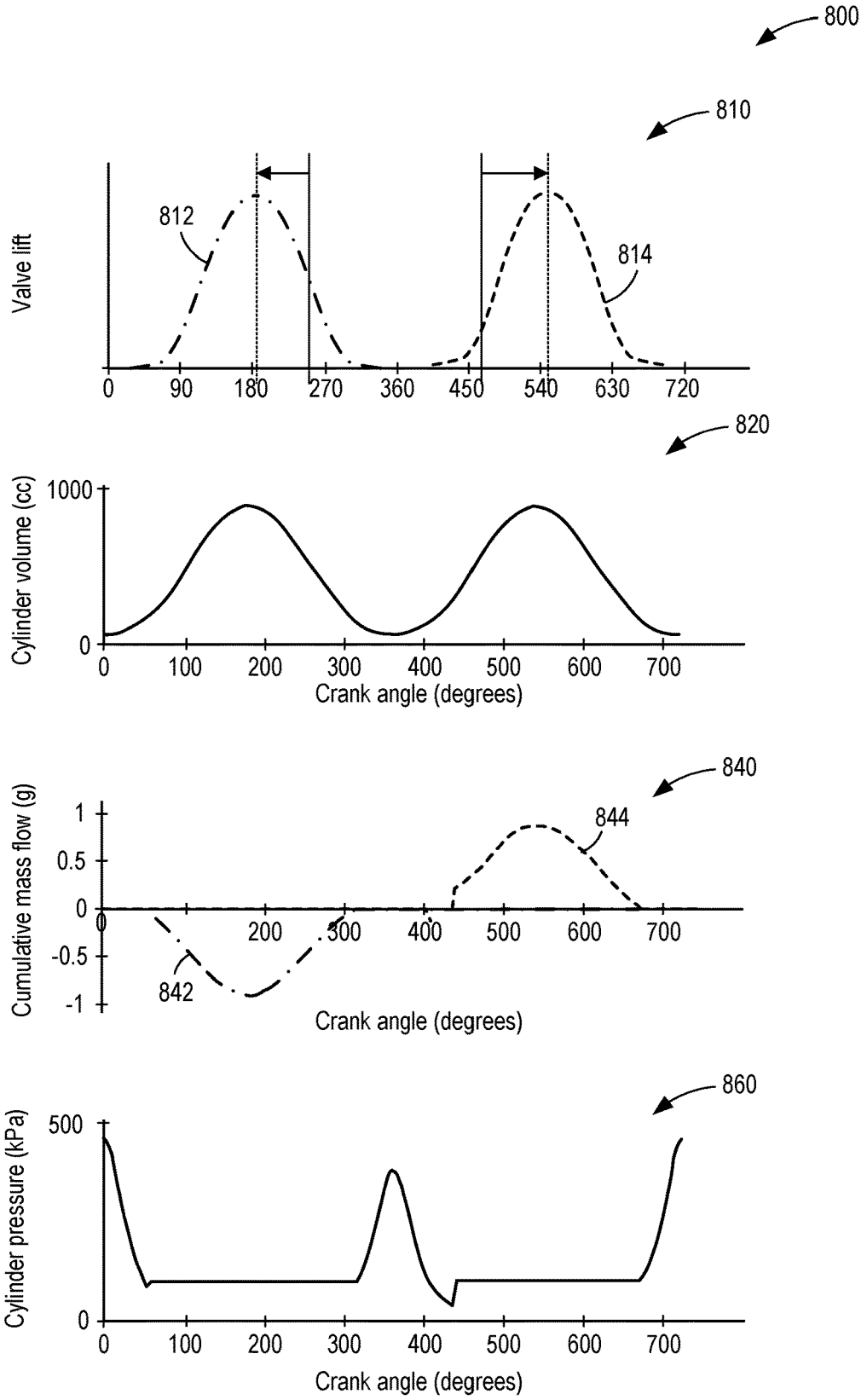
FIG. 8 shows a third set of graphs representing a cam phasing corresponding to the camshaft assembly of FIG. 4.
Figure 9:
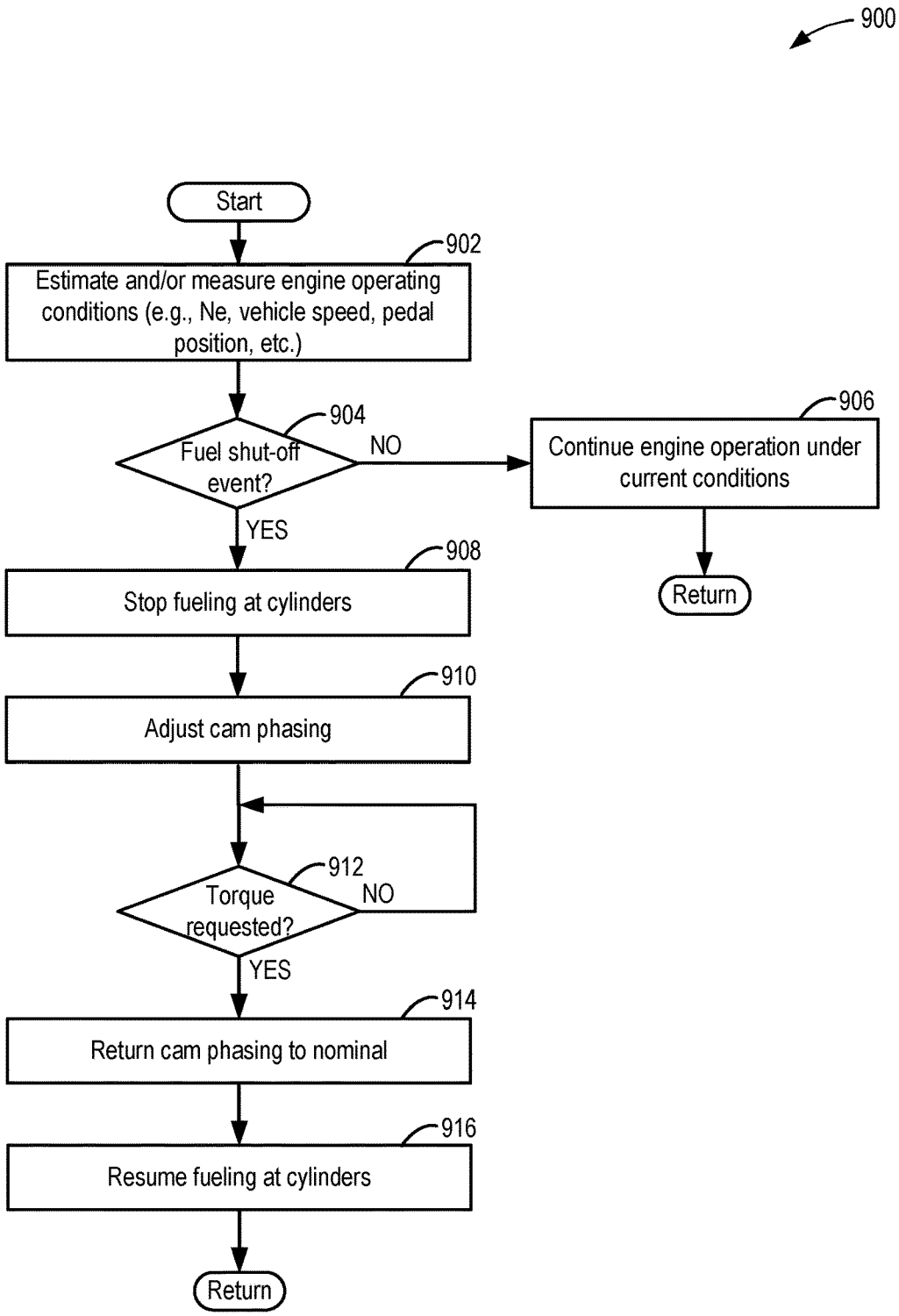
FIG. 9 shows an example of a method for adjusting a cam phasing during a fuel shut-off event.
Figure 10:
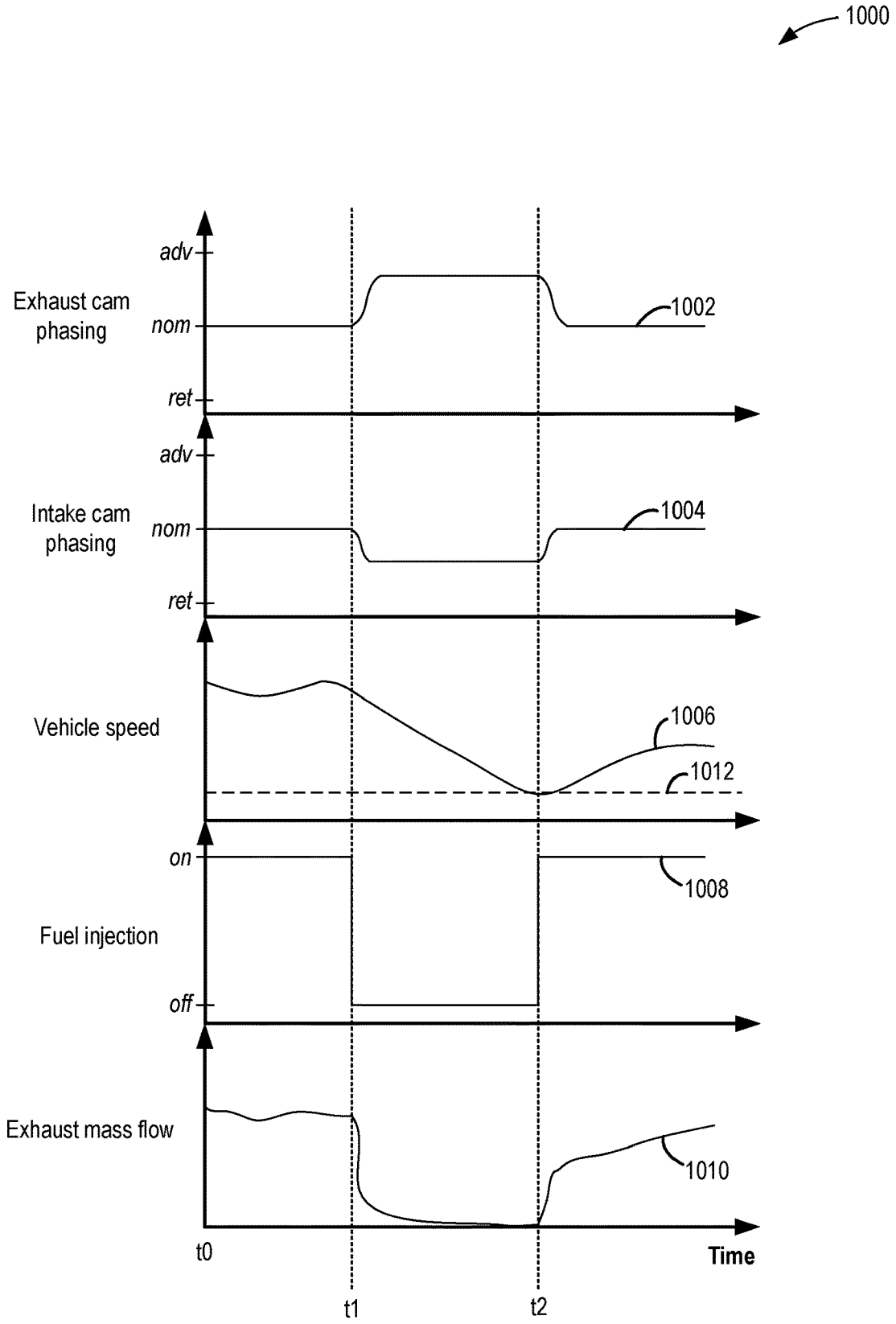
FIG. 10 shows example vehicle operations and engine parameters during a fuel shut-off event.
Figure 11:
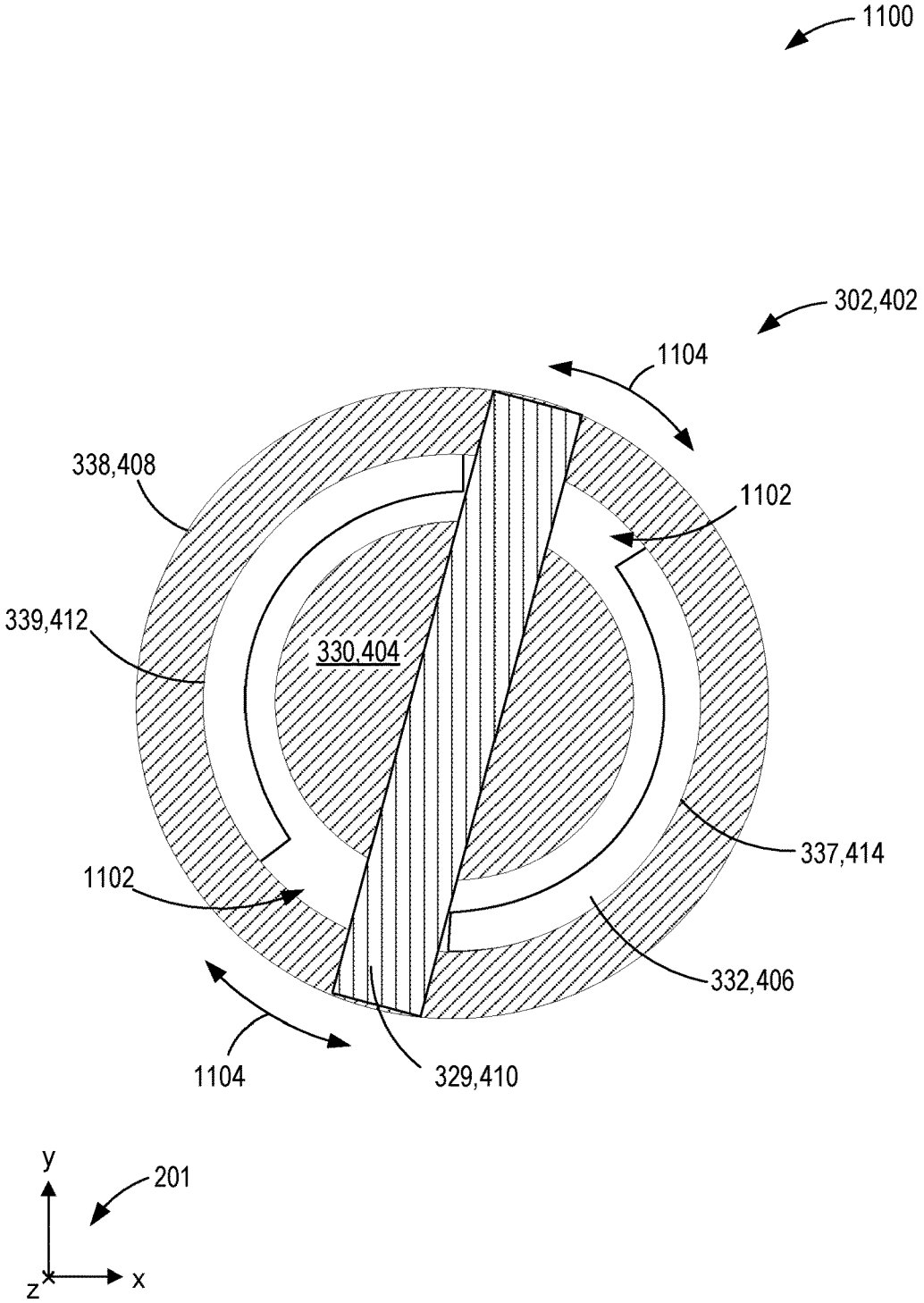
FIG. 11 shows a second cross-section of the camshaft assemblies of FIGS. 3 and 4.

The following description relates to systems and methods for reducing air flow to an exhaust aftertreatment device, e.g., an emission control device, during a fuel shut-off event. One or more cylinders of an engine may be deactivated during certain conditions, such as a reduction in vehicle speed and/or a decrease in torque demand. An example of an engine system, including an engine coupled to an exhaust system is depicted in FIG. 1. The exhaust system may include the emission control device adapted with a catalyst for converting combustion by-products prior to atmospheric release. During the fuel shut-off event, accumulation of oxygen at the catalyst may be mitigated by configuring the engine with a camshaft assembly that allows cam phasing to be adjusted. In particular, the camshaft assembly may be implemented in a pushrod engine, as illustrated in FIG. 2, where intake valves and exhaust valves of the engine are actuated by a single, in-block camshaft. The camshaft assembly may include two concentric portions controlled by a planetary gear mechanism. Two examples of the camshaft assembly are shown in FIGS. 3 and 4, and a first common cross-section of a planetary gear system of the exemplary camshaft assemblies is shown in FIG. 5. A second common cross-section of the camshaft assemblies of FIGS. 3 and 4 is depicted in FIG. 11, showing details of the two concentric portions. An example of intake and exhaust valve timing for a conventional camshaft assembly is shown in a first set of graphs in FIG. 6 and exemplary valve timing corresponding to the camshaft assemblies of FIGS. 3 and 4 are depicted in FIGS. 7 and 8, respectively. An example of a method for adjusting cam phasing during the fuel shut-off event to maintain catalyst conversion efficiency after the fuel shut-off event is shown in FIG. 9. Variations in vehicle operations and engine parameters occurring during execution of the fuel shut-off event are illustrated in FIG. 10.

FIGS. 1-5 and 11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Turning to the figures, FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutch 56 is engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems, including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based on system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from the engine, and exhaust turbine 176 may be optionally omitted. In still other examples, engine 10 may be provided with an electric supercharger and compressor 174 may be driven by an electric motor.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor. Emission control device 178 may be a three-way catalyst, a NOx trap, various other emission control devices, or combinations thereof. In the example of FIG. 1, emission control device 178 is a three-way catalyst.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. For example, valve actuators may be a cam actuation type and the intake and exhaust valve timing may be controlled concurrently, and any of a possibility of variable intake cam timing, variable exhaust cam timing, dual independent variable cam timing, or fixed cam timing may be used. In some examples, the cam actuation system may be a single cam and may utilize one or more of cam profile switching (CPS), variable cam timing (VCT), variable valve timing (VVT), and/or variable valve lift (VVL) systems that may be operated by controller 12 to vary valve operation. In one example, as described further below, a timing of valve actuation is adjusted by cam phasing which is enabled by a single cam assembly. The cam assembly may include a camshaft with two concentric portions where concentric portions control actuation of the intake and exhaust valves. Phasing of the two concentric portions is adjusted by an actuator including a planetary gear system and a phasing mechanism coupled to the planetary gear system. Details of the cam assembly are described further below with reference to FIGS. 3-5.

Cylinder 14 can have a compression ratio, which is a ratio of volumes when piston 138 is at bottom dead center (BDC) to top dead center (TDC). In one example, the compression ratio is in the range of 9:1 to 10:1. However, in some examples, the compression ratio may be increased when different fuels are used. This may happen, for example, when higher octane fuels or fuels with a higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed and engine load, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and may be further configured to inject this fuel mixture directly into cylinder 14. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

Controller 12, which may include a powertrain control module (PCM), is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 135; a profile ignition pickup signal (PIP) from a Hall effect sensor 120 (or other type) coupled to crankshaft 140; a throttle position signal (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

Controller 12 receives signals from the various sensors of FIG. 1, processes the received signals, and employs the various actuators of FIG. 1 (e.g., fuel injector 166 and spark plug 192) to adjust engine operation based on the received signals and instructions stored on a memory of the controller. For example, the controller may receive a request for slowing of the vehicle based on input from the accelerator pedal (e.g., the accelerator pedal is released). In response to the request, the controller may command fuel injection at one or more cylinders to stop, thereby reducing fuel consumption during a period where torque is not demanded.

As described above, FIG. 1 shows only one cylinder of a multi-cylinder engine. As such, each cylinder may similarly include its own set of intake/exhaust valves, fuel injector(s), spark plug, etc. Furthermore, in some examples, engine 10 may be configured as a diesel engine and may rely on compression of air in the cylinder to achieve a self-igniting air temperature before injecting fuel into the cylinder. Thus, the spark plug may be omitted in engine 10 when configured to combust diesel. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

As described above, in some conditions, such as where reduction in vehicle speed is desired, the controller may selectively deactivate fueling and/or ignition provided to one or more cylinders in a fuel shut-off event, such as when the vehicle is in a deceleration fuel shut-off (DFSO) mode. Further, the controller may vary a number of cylinders that are operated in the DFSO mode. As described herein, a cylinder operating in a DFSO mode may also be referred to as a deactivated cylinder. Adjusting the cylinder to operate in the DFSO mode may include continuing to flow air into the cylinder while fuel injection is halted. As a result, the air may flow through an exhaust system, e.g., the exhaust manifold 148 and emission control device 178 of FIG. 1. When the emission control device includes a three-way catalyst, configured to oxidize hydrocarbons and carbon monoxide while reducing nitrogen oxides, an excess of oxygen at the catalyst may degrade a conversion efficiency of the catalyst. The air flow through the catalyst may also carry heat away from the catalyst, reducing its temperature and conversion efficiency.

To mitigate poor catalyst performance, extra fuel may be injected at the deactivated cylinder after cylinder exits the DFSO mode and is reactivated. The extra fuel injection may provide additional hydrocarbons to react with excess oxygen stored at the catalyst. While combusting additional fuel may boost catalyst efficiency, a fuel economy of the vehicle may be decreased as a result. The reduced fuel economy of the vehicle following a fuel shut-off event may be at least partially addressed by modifying a cam phasing to decrease air flow through the engine during the fuel shut-off event. In one example, the engine may have a single cam assembly controlling actuation of intake and exhaust valves. An example of the engine 200 is depicted in FIG. 2.

Turning now to FIG. 2, engine 200 may be an embodiment of engine 10 of FIG. 1, configured to combust diesel, and includes an engine block 212 having a first cylinder bank 214 and a second cylinder bank 216 arranged at an angle relative to one another, typically referred to as a "V" configuration or "V"-type engine. A set of reference axes 201 are provided for comparison between views shown, indicating a y-axis, an x-axis, and a z-axis. In one example, the y-axis may be parallel with a direction of gravity. A space disposed generally between cylinder banks 214, 216 is also known as a valley of engine 200. Cylinder banks 214, 216 are longitudinally (relative to a forward/rearward direction along a vehicle) offset relative to one another by a distance known as a bank offset. While illustrated and described with respect to a V-type engine, the present disclosure is not necessarily limited to a particular cylinder bank configuration and other cylinder bank geometries are possible.

Engine 200 includes a first cylinder head and a second cylinder head (omitted in FIG. 2 for clarity) associated with corresponding cylinder banks 214, 216 that define an upper portion of cylinders 222 and contain various intake, exhaust, and cooling passages. Fuel injectors 220 may be positioned at each of the cylinders 222 with each fuel injector 220 secured within a respective cylinder head and extending into a respective cylinder 222 of engine block 212. Fuel injectors 220 associated with one of the cylinder banks 214, 216 may be connected to a corresponding common fuel rail (not shown) that delivers pressurized fuel from a fuel pump 228 disposed in the valley generally forward of exhaust manifolds 230, 232. Depending on the particular application and implementation, engine 200 may include more than one fuel pump 228. Both compression ignition, such as diesel-fueled engines, and spark ignition, such as gasoline fueled engines, may use direct injection strategies where fuel is injected directly into the combustion chamber during operation. Spark ignition may also use PFI, as described above with reference to FIG. 1. An electric low-pressure fuel pump may be located in or near a fuel tank providing fuel to a mechanical high-pressure fuel pump driven by rotation of the engine camshaft or crankshaft.

Each exhaust manifold 230, 232 is disposed on an inboard side of an associated cylinder head and connects exhaust passages from cylinders 222 within a corresponding bank 214, 216 to a turbine of at least one turbocharger 240, 242 disposed in the valley of engine 200. A compressor of the at least one turbocharger 240, 242 may be connected to an intake system 244 disposed generally on an outboard side of the cylinder banks 214, 216 and corresponding cylinder heads. Intake manifolds 246, 248 distribute intake air from the intake system 244 to each of the various cylinders 222 from the outboard side of engine 200.

Engine block 212 includes a bore 250 adapted to receive a camshaft used for actuating the intake/exhaust valves of the engine valvetrain via corresponding pushrods extending through the cylinder heads. As such, engine 200 may be referred to as a cam-in-block or pushrod engine. In the embodiment illustrated in FIG. 2, engine 200 is a V-8 engine with four cylinders 222 in each bank 214, 216 and two valves per cylinder, e.g., one intake valve and one exhaust valve (such as the intake valve 150 and the exhaust valve 156 of FIG. 1), each with a separate or dedicated pushrod. As such, engine block 212 and the cylinder heads for banks 214, 216 accommodate a total of sixteen pushrods that extend therethrough to actuate corresponding intake/exhaust valves.

It will be appreciated that engine 200 of FIG. 2 is a non-limiting example of a pushrod engine in which air flow through the engine may be adjusted during fuel shut-off events. Other examples may include variations in quantities and configurations of the intake manifold(s), exhaust manifold(s), turbines, cylinders, and intake/exhaust valves without departing from a scope of the present disclosure.

For a pushrod engine, such as engine 200 of FIG. 2, where a single camshaft is used to actuate intake and exhaust valves of the engine cylinders, a timing of the valve actuation may be adjusted by implementing a cam assembly configured to selectively vary cam phasing. The cam assembly includes the camshaft and further includes a planetary gear system and a phasing mechanism. The camshaft may include a first portion, configured to control a first set of valves (e.g., either the intake or exhaust valves) of the cylinders, and a second portion, configured to a control a second set of valves (e.g., either the exhaust or intake valves). The first portion and the second portion may be concentric and rotated by different components of the planetary gear system. A first example of such a camshaft assembly 300 is depicted in FIG. 3 from a cross-sectional view.

The camshaft assembly 300 of FIG. 3 includes a camshaft 302 with a planetary gear system 304 arranged at one end of the camshaft 300. The camshaft 302 has a first portion 330 and second portion 332 which are concentric and configured to rotate independent of one another, as described further below. Rotation of the camshaft 302 about a central axis 301 may be synchronized with rotation of a crankshaft, e.g., the crankshaft 140 of FIG. 1 via a coupling mechanism, such as a timing belt/chain or a gear drive. For example, the timing belt may surround a carrier 306 of the planetary gear system 304 as well as a gear of the crankshaft, thereby transmitting rotation of the crankshaft to the camshaft. As such, the carrier 306 may be a rotational input of the planetary gear system 304 and drive motion of other components of the planetary gear system 304. In one example, the camshaft may rotate at half of a rotational speed of the crankshaft.

The carrier 306 includes planets 308 arranged along an inner face 310 (e.g., facing the camshaft 302) of the carrier 306. The planets 308 may protrude from the inner face 310 of the carrier 306 along the z-axis and rotate about posts 303. The posts 303 may be continuous with the carrier 306 such that the posts 303 do not move relative to the carrier 306. A sun gear 312 may be positioned between the planets 308 of the carrier 306 where an edge surface 314 of the sun gear 312 is in contact with outer surfaces 316 of the planets 308. A diameter 318 of the sun gear 312 may be smaller than a diameter 320 of the carrier 306.

The planets 308 of the carrier 306 may be surrounded by a ring gear 322 such that an inner surface 324 of the ring gear is in contact with the outer surfaces 316 of the planets 308. An outer diameter 326 of the ring gear 322 may be larger than the diameter 318 of the sun gear and smaller than or similar to the diameter 320 of the carrier 306. A configuration of the planetary gear system 304 is shown in FIG. 5 from a first cross-section 500 of the planetary gear system.

The first cross-section 500 of FIG. 5 may be taken along line A-A' of FIG. 3 as well as line B-B' of FIG. 4. Along the y-x plane, the planets 308, the sun gear 312, and the ring gear 322 each have circular geometries (as well as the carrier 306). Each of the outer surfaces 316 of the planets 308, the edge surface 314 of the sun gear 312, and the inner surface 324 of the ring gear 322 may be adapted with teeth configured to mesh with teeth on an interfacing surface (not shown in FIG. 5). For example, the teeth along the outer surface of the planets 308 may be similarly sized and spaced apart as both the teeth on the edge surface 314 of the sun gear 312 and the teeth on the inner surface 324 of the ring gear 322. As the surfaces come into contact, the teeth of one surface fit into gaps between the teeth of the other surface. As such, smooth, continuous motion of the planetary gear system 304 is enabled when components of the planetary gear system 304 are rotating.

Relative motion of the planetary gear system components, e.g., rotation of the planets 308, the sun gear 312, and the ring gear 322 with respect to one another, may be adjusted by varying engagement of the components. For example, one component may be locked to another such that the components may move in unison. When unlocked, the components may rotate (or not rotate) independently. As one example, the carrier 306 (as shown in FIGS. 3 and 4) may rotate in a clockwise direction, as indicated by arrow 502, driving turning of the planets 308 around the central axis 301 in the clockwise direction, as indicated by arrows 504. When the sun gear 312 is locked to the carrier 306 by a phasing mechanism (e.g., a phasing mechanism 328 as shown in FIGS. 3 and 4 and described further below), the sun gear 312 rotates in unison with the carrier 306. Furthermore, the ring gear 322 is locked to the carrier 306 by contact between the outer surfaces 316 of the planets 308 and the inner surface 324 of the ring gear 322 (e.g., the teeth of the surfaces are meshed). The ring gear 322 thereby also rotates in unison with the carrier 306. As such, the planetary gear system 304 may rotate as a single unit.

However, when adjustment of an orientation of the sun gear 312 relative to the carrier 306 is desired, the phasing mechanism 328 may be actuated to change a position of the sun gear 312 with respect to the carrier 306. For example, as the camshaft assembly 300 continues to rotate (e.g., arrow 502) during unfueled engine operation, driving rotation of the carrier 306, the phasing mechanism 328 may turn the sun gear 312 relative to the carrier 306. In one example, the phasing mechanism 328 may turn the sun gear 312 in a direction opposite of the arrow 504, e.g., in a counter-clockwise direction, as indicated by arrow 508. As the sun gear 312 is adjusted relative to the carrier 306 by the phasing mechanism 328, the ring gear 322 is also adjusted relative to the sun gear 312 and the carrier 306 by engagement with the planets 308. For example, as the sun gear 312 is turned as indicated by arrow 508, the planets 308 may rotate as indicated by arrows 506 which drives rotation of the ring gear 322 as indicated by arrow 510. Each of the sun gear 312 and the ring gear 322 are thereby adjusted relative to the carrier 306 in opposite directions. It will be appreciated that the phasing mechanism 328 may similarly adjust the positions of the sun gear 312 and the ring gear 322 by turning the sun gear 312 in an opposite direction from that shown by arrow 508, driving rotation of the planets 308 and the ring gear 322 in opposite directions from those indicated by arrows 506 and 510. The opposing rotations of the sun gear 312 and the ring gear 322 may be leveraged to regulate cam phasing as described further below.

Returning to FIG. 3, the sun gear 312 may be rotated relative to the carrier 306 by the phasing mechanism 328 to change an angle of the sun gear 312 relative to the carrier. In one example, the phasing mechanism 328 may be a hydraulic VCT phaser configured with vanes that are coupled to the sun gear 312 and forming pockets within the carrier 306. A hydraulic pressure of the phasing mechanism 328 may be controlled by a solenoid-actuated spool valve and when a hydraulic fluid, such as oil, is directed to one side of the vanes, the vanes may move in a first direction relative to the carrier 306, driving rotation of the sun gear 312 in the first direction. When the oil is directed to a second, opposite side of the vanes and vented from the first side, the vanes and the sun gear 312 may rotate in a second, opposite direction. By regulating the oil supply, an orientation of the sun gear 312, with respect to the carrier 306, may be locked at a first end position when rotated in the first direction and locked in a second end position when rotated in the second direction. In some examples, the orientation of the sun gear 312 may also be locked at positions in between the first and second end positions. In another example, the phasing mechanism 328 may instead be electrically actuated. For example, an electric motor and reduction gear assembly may be used to control the relative orientations of the sun gear 312 and the carrier 306.

Each of the first portion 330 and the second portion 332 of the camshaft 302 may be coupled to different components of the planetary gear system 304 and may rotate in unison about the central axis 301 such that the camshaft 302 rotates as a single unit with the planetary gear system 304 during nominal engine operation (e.g., when the engine is fueled and sparked). When the phasing mechanism 328 is commanded to change phasing, the orientations of the first portion 330 and the second portion 332 change relative to each other and relative to the carrier 306.

The sun gear 312 may be coupled to the first portion 330 of the camshaft 302. In one example, the sun gear 312 and the first portion 330 of the camshaft 302 may form a unitary, continuous structure. In other examples, the sun gear 312 and the first portion 330 of the camshaft 302 may be connected by welding, fasteners, etc. The first portion 330 of the cam shaft 302 may be a solid rod or a tube forming an inner portion, or core, of the cam shaft 302. Although depicted to extend linearly along the central axis 301 in FIGS. 3 and 4, a geometry of the first portion 330 (and an overall geometry of the camshaft 302) may vary. For example, the camshaft 302 may include offset, staggered sections.

The ring gear 322 may be similarly coupled to the second portion 332 of the camshaft 302. The second portion 332 may have a hollow, generally cylindrically structure, forming an outer shell or sleeve around the first portion 330. As such, the first portion 330 and the second portion 332 of the camshaft 302 may be concentric, with the second portion 332 circumferentially surrounding the first portion 330 along a length of the camshaft 302, where the length is parallel with the central axis 301.

In one example, an outer surface 334 of the first portion 330 of the camshaft 302 may be in face-sharing contact with an inner surface 336 of the second portion 332 of the camshaft 302. However, in other examples, a small gap may be present between the outer surface 334 of the first portion 330 and the inner surface 336 of the second portion 332. In some examples, a lubricant such as oil may be stored in the small gap between the outer surface 334 of the first portion 330 and the inner surface 336 of the second portion 332 to reduce friction between the portions when the portion rotate relative to one another. Furthermore, in some examples, the outer surface 334 of the first portion 330 and the inner surface 336 of the second portion 332 may each include sections with different diameters such that there is a gap in some areas and face-sharing contact in other areas. The face sharing contact may be used to keep the first portion 330 and the second portion 332 concentric, but also allows for rotational movement between the portions. As such, an interface between the first portion 330 and second portion 332 may be configured to enable smooth and low friction rotation of the first portion 330 within the second portion 332 of the camshaft 302.

Each of the first portion 330 and the second portion 332 of the camshaft 302 may be configured with cam lobes and journals to control intake/exhaust valve lift and support a position and rotation of the camshaft 302. For example, the first portion 330 may be coupled to a sleeve 338 arranged concentric with and circumferentially surrounding the second portion 332 of the camshaft 302 along at least a portion of the length of the camshaft 302. The sleeve 338 may be positioned along the second portion 332 of the camshaft 302 in a region of the second portion 332 that is empty, e.g., free of cam lobes or journals. Furthermore, the sleeve 338 may be located between a first journal 344 and a second journal 346 arranged along the second portion 332 of the camshaft 302 and positioned closer and adjacent to the second journal 346 than the first journal 344.

The first journal 344 may be positioned closer to the planetary gear system 304 than the second journal 346. The sleeve 338 may be connected to the first portion 330 of the camshaft by the pin 329 which may extend through an opening in the second portion 332 of the camshaft 302. The sleeve 338 may extend along the length of the camshaft 302 in a direction from the pin 329 to the first journal 344, e.g., toward the planetary gear system 304, such that the pin 329 is located at an end of the sleeve 338 distal to the planetary gear system 304. In other words, the sleeve 338 may be positioned proximate and adjacent to the second journal 346 and extend a portion of a distance 341 between the second journal 346 and the first journal 344.

An inner surface 339 of the sleeve 338 may be in face-sharing contact with an outer surface 337 of the second portion 332 of the camshaft 302. The surfaces may be smooth, allowing the surfaces to rotate in opposite directions with minimal friction. In addition, the opening in the second portion 332 of the camshaft 302 through which the pin 329 extends may be a slot extending along a circumferential direction (e.g., perpendicular to the central axis 301) to allow movement of the pin 329 along the slot when the sleeve 338 and the first portion 330 of the camshaft 302 are rotated around the central axis 301 relative to the second portion 332. Further details of the pin 329 and the slot are shown in FIG. 11 in a second cross-section 1100. The second cross-section 1100 may be taken along line C-C' of FIG. 3 as well as line D-D' of FIG. 4. As such components in FIG. 11 are labelled corresponding to equivalent components in FIG. 3 and FIG. 4.

As depicted in FIG. 11, the pin 329 extends entirely across a diameter of the sleeve 338 and may be attached at either end to the sleeve 338. A central region of the pin 329 extends through the first portion 330 of the camshaft 302 such that the first portion 330, the pin 329, and the sleeve 328 are fixedly coupled and rotate in unison. Slots 1102 are disposed in the second portion 332 of the camshaft 302 through which the pin 329 extends. The slots 1102 may allow the pin to rotate with respect to the second portion 332 of the camshaft 302, as indicated by arrows 1104, through a fixed angle, such as 40 degrees. However, the fixed angle may vary in other examples.

Returning to FIG. 3, the sleeve 338 may include a first cam lobe 340 configured to actuate an exhaust valve of a first cylinder of a first cylinder bank, e.g., the first cylinder bank 214 of FIG. 2, and a second cam lobe 342 configured to actuate an exhaust valve of a first cylinder of a second cylinder bank, e.g., the second cylinder bank 216 of FIG. 2. Hereafter, the first cam lobe 340 is referred to as a first exhaust cam 340 and the second cam lobe 342 is referred to as a second exhaust cam 342. The first and second exhaust cams 340, 342 may be eccentrics enabling opening and closing of the exhaust valves as the camshaft assembly 300 rotates. The first exhaust cam 340 is positioned closer to the first journal 344 than the second exhaust cam 342 and the second exhaust cam 342 is positioned closer to the second journal 346 of the second portion 332 of the camshaft 302 than the first exhaust cam 340. The pin 329 may be located closer to the second journal 346 than the second exhaust cam 342.

The second portion 332 of the camshaft 302 may include a first cam lobe 348 configured to actuate an intake valve of the first cylinder of the first cylinder bank and a second cam lobe 350 configured to actuate an intake valve of the first cylinder of the second cylinder bank. Hereafter, the first cam lobe 348 is referred to as a first intake cam 348 and the second cam lobe 350 is referred to as a second intake cam 350. The first and second intake cams 348, 350 may also be eccentrics enabling opening and closing of the intake valves as the camshaft assembly 300 rotates and may be positioned between the first journal 344 and the first exhaust cam 340. The first intake cam 348 is positioned closer to the first journal 344 than the second intake cam 350 and the second intake cam 350 is positioned closer to the first exhaust cam 340 than the first intake cam 348. Both the first and second intake cams 348, 350 are located closer to the planetary gear system 304 along the length of the camshaft 302 than the first and second exhaust cams 340, 342.

The sequence of intake and exhaust cams between the journals (e.g., the first journal 344 and the second journal 346) of the camshaft 302 may be repeated along the length of the camshaft 302, e.g., along the z-axis. It will be noted that the first journal 344 is equivalent to the second journal 346 with respect to positioning and geometry. The camshaft 302 may therefore include more than one of the sleeve 338 connected to the first portion 330 of the camshaft 302 by the pin 329. In other words, the configuration of journals, intake cams and exhaust cams shown in FIG. 3 may be repeated for each set of parallel cylinders of the cylinder banks, e.g., for a second cylinder of each of the first cylinder bank and the second cylinder bank, for a third cylinder of each of the first cylinder bank and the second cylinder bank, etc.

By coupling the first and second exhaust cams 340, 342 to the first portion 330 of the cam shaft (e.g., via the sleeve 338 and the pin 329) and to the sun gear 312 and coupling the first and second intake cams 348, 350 to the second portion 332 of the cam shaft 302 and to the ring gear 322, cam phasing may be adjusted by the planetary gear system 304. For example, when the phasing mechanism 328 is adjusted to change the phasing angle (e.g. by hydraulically moving the vanes coupled to the sun gear 312 relative to the pockets of the carrier 306), the sun gear 312 and the ring gear 322 may turn in opposite directions relative to the carrier 306, as shown in FIG. 5. The exhaust cams (e.g., the first and second exhaust cams 340, 342) may be turned in unison with the sun gear 312 and the intake cams (e.g., the first and second intake cams 348, 350) may be turned in unison with the ring gear 322. The exhaust cams are therefore turned in an opposite direction from the intake cams and phased according to a target angle provided by the phasing mechanism 328. The cam phasing enabled by the camshaft assembly 300 of FIG. 3 will be described further below with reference to FIGS. 6 and 7.

Cam phasing may be similarly adjusted by a second example of a camshaft assembly 400 illustrated in FIG. 4, also from a cross-sectional view. The camshaft assembly 400 includes the planetary gear system 304 of FIGS. 3 and 5 and a camshaft 402 with a central axis 401. The camshaft 402 also includes a first portion 404, forming a cylindrical inner core of the camshaft 402, and a second portion 406, concentric with and circumferentially surrounding the first portion 404. Surfaces of the first portion 404 and the second portion 406 may be configured to allow the first portion 404 and the second portion 406 to rotate relative to one another with minimal resistance, as described above with respect to the camshaft 302 of FIG. 3. The first portion 404 is coupled to the sun gear 312 such that the first portion 404 spins in unison with the sun gear 312 and the second portion 406 is coupled to the ring gear 322 such that the second portion 406 spins in unison with the ring gear 322, as described above.

However, a configuration of exhaust and intake cams along the camshaft 402 is different from that of the camshaft 302 of FIG. 3. For example, a sleeve 408 is connect to the first portion 404 of the camshaft 402 by a pin 410, similar to the pin 329 of FIG. 3. The pin 410 may extend through an opening or slot in the second portion 406 of the camshaft 402, as described above and depicted in FIG. 11. The sleeve 408 may circumferentially surround the second portion 406 of the camshaft 402 along a portion of a length (e.g., defined along the central axis 301) of the camshaft 402 such that an inner surface 412 of the sleeve 408 may be in face-sharing contact with an outer surface 414 of the second portion 406. The sleeve 408 is located between a first journal 416 and a second journal 418 coupled to the second portion 406 of the camshaft 402, where the second journal 418 is further away from the planetary gear system 304 than the first journal 416.

The sleeve 408 may extend away from planetary gear system 304 along the length of the camshaft 402. For example, the pin 410 may be coupled to an end of the sleeve 408 proximate and adjacent to the first journal 416 and extend away from the first journal 416 toward the second journal 418. However, the sleeve 408 may only extend a portion of a distance 421 between the first journal 416 and the second journal 418. A first intake cam 420 and a second intake cam 422 may be coupled to the sleeve 408, positioned such that the first intake cam 420 is adjacent and closer to the first journal 416 than the second intake came 422. Moreover, the pin 410 is located closer to the first journal 416 than the first intake cam 420.

A first exhaust cam 424 and a second exhaust cam 426 may be coupled to the second portion 406 of the camshaft 402. The exhaust cams may be positioned between the second intake cam 422 and the second journal 418 with the first exhaust cam 424 located adjacent and closer to the second intake cam 422 than the second exhaust cam 426. As described above for the first example of the cam shaft assembly 300 of FIG. 3, a sequence of intake and exhaust cams between the journals (e.g., the first journal 416 and the second journal 418) of the camshaft 402 may be repeated along the length of the camshaft 402 for each cylinder of a cylinder bank to which the intake and exhaust cams are coupled.

The first journal 416 and the second journal 418 may be equivalent, e.g., similarly configured. A geometry of the journals of the second example of the camshaft assembly 400 of FIG. 4 may be different from the journals of the camshaft assembly 300 of FIG. 3, however. Due to a shape of the sleeve 408 coupled to the first portion 404 of the camshaft 402 and a placement of the pin 410 relative to the sleeve 408, the first and second journals 416, 418 may each have a journal ring 428 offset from a hub 430 of the first and second journals 416, 418. The hub 430 may be directly coupled to the second portion 406 of the camshaft 402 and protrude radially away from the central axis 401, at a region adjacent to the sleeve 408 and at an end of the sleeve 408 proximate to the planetary gear system 304. The journal ring 428 may protrude from the hub 430 in a direction radially away from the central axis 401 as well as a direction parallel with the central axis 401 and away from the planetary gear system 304. The journal ring 428 may thereby overlap with a portion of the sleeve 408 relative to the y-axis. By configuring the journals with the journal ring 428 that is offset with respect to the hub 430, an alignment of the journals with bearings, the bearings configured to support a position of the camshaft 402 in the engine, may be maintained. In other words, the hub 430 of each journal allows the journal ring 428 to have a similar spacing and alignment with the bearings as the journals of the camshaft 302 of FIG. 3.

In contrast to the camshaft 302 of FIG. 3, the intake cams (e.g., the first intake cam 420 and the second intake cam 422) are coupled to the sun gear 312 via the pin 410 and the first portion 404 of the camshaft 402 while the exhaust cams (e.g., the first exhaust cam 424 and the second exhaust cam 426) are coupled to the ring gear 322. However, cam phasing adjustment is also enabled by the planetary gear system 304 as described above for FIG. 5. For example, the phasing mechanism 328 may similarly rotate the sun gear 312 and the ring gear 322 in opposite directions, thereby changing the orientations of the gear relative to the carrier 306. As a result, the phasing of the intake cams and the exhaust cams are varied according to the adjusted orientations of the sun gear 312 and the ring gear 322. Further details of the cam phasing enabled by the second example of the camshaft assembly 400 of FIG. 4 is described below with reference to FIGS. 6 and 8.

Both the first example and the second example of the camshaft assembly depicted in FIGS. 3 and 4 may reduce airflow to the exhaust system during fuel shut-off events. Due to the planetary gear system, when the phasing mechanism rotates the sun gear in one direction (relative to the carrier) by a given angle, the ring gear rotates in the opposite direction (relative to the carrier) by a smaller angle. As a result, in the first example of the camshaft assembly 300 of FIG. 3, the intake cams may phase less than the exhaust cams, and in the second example of the camshaft assembly 400 of FIG. 4, the intake cams may phase more than the exhaust cams. Selection of the either the first example or the second example of the camshaft assembly may depend on the initial cam events and the resulting net airflow that can be achieved when phasing the cams. Selection may also depend on a desired peak pressure in the cylinders when airflow is reduced through phasing. An effect of cam phasing adjustment on cylinder operation during a fuel shut-off event is described below with reference to FIGS. 6-8.

Figure 6:
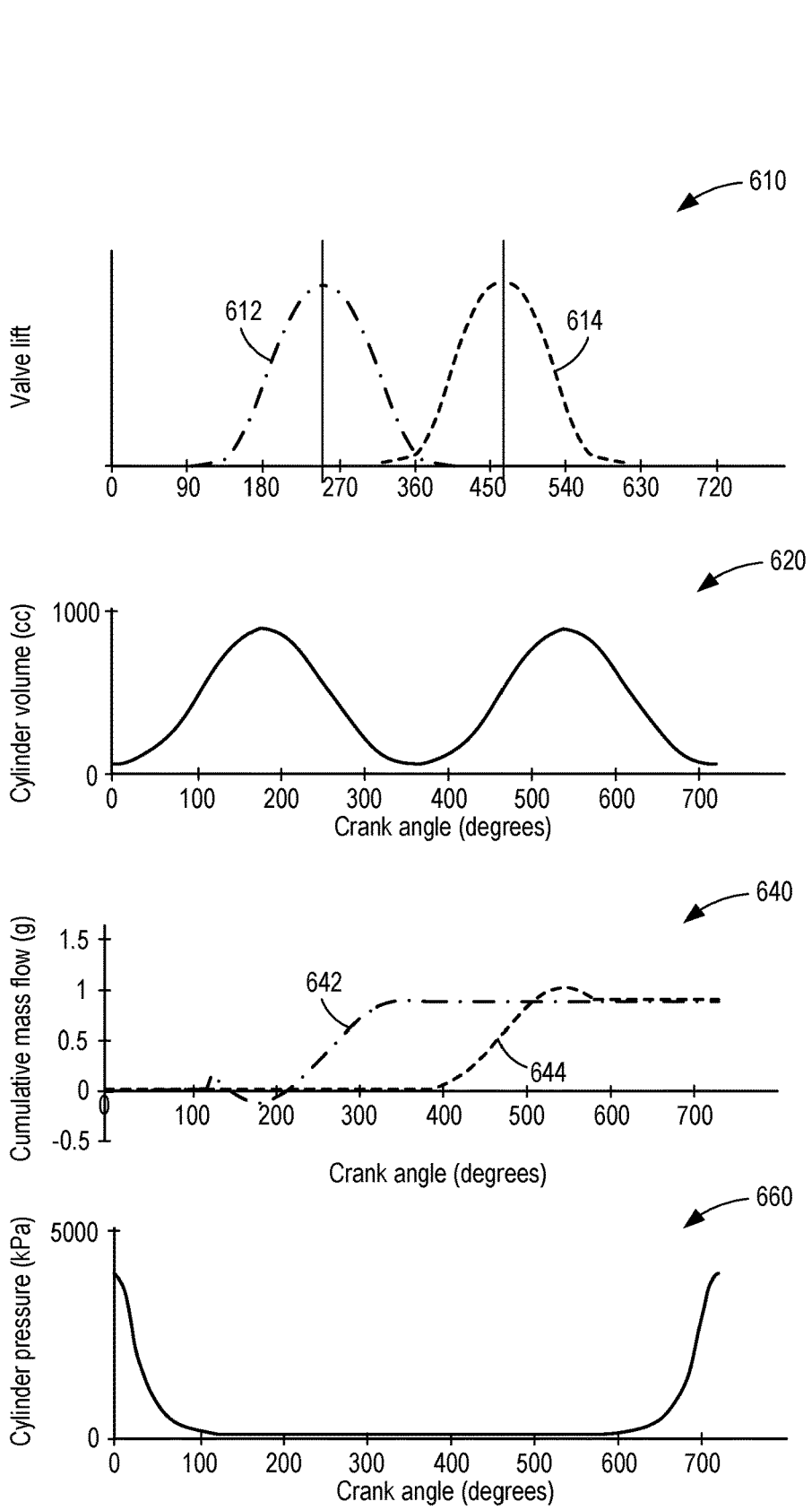
FIG. 6 shows a first set of graphs representing a conventional cam phasing.

A first set of graphs 600 showing a nominal cam phasing at cylinders of an engine, such as the engine 200 of FIG. 2, is shown in FIG. 6. The first set of graphs 600 are plotted relative to crank angle along the x-axis and includes a first graph 610, depicting valve (e.g., intake valve and exhaust valve) lift, a second graph 620 depicting cylinder volume in cubic centimeters, a third graph 640 depicting cumulative mass flow through each cylinder in grams, and a fourth graph 660 depicting cylinder pressure in kPa.

The first graph 610 includes a first plot 612 depicting exhaust valve lift and a second plot 614 depicting intake valve lift. For example, as shown at the first plot 612, the exhaust valve of each cylinder of the engine may be opened for a duration of 260 degrees of crank angle, from 120 degrees to 380 degrees, corresponding to a change in cylinder volume from high to low (e.g., during an exhaust stroke). As shown at the second plot 614, the intake valve is opened for 235 degrees of crank angle, from 345 degrees to 580 degrees, corresponding to a change in cylinder volume from low to high (e.g., during an intake stroke). Opening of the intake valve may overlap with opening of the exhaust valve, e.g., for 35 degrees of crank angle.

As shown in the second graph 620, the cylinder volume oscillates between a low volume, such as close to zero, and a high volume, such as 1000 cc, as a crankshaft rotates and drives piston movement. The third graph 640 shows a first plot 642 of exhaust mass flow through each cylinder, e.g., mass flow through an exhaust valve, corresponding to the nominal cam phasing. Exhaust mass flow increases while the exhaust valve is open and then plateaus after the exhaust valve closes. Cylinder pressure, as shown in the fourth graph 660, is low while the exhaust valve is open.

The third graph 640 also includes a second plot 644 showing intake mass flow through each cylinder, e.g., mass flow through an intake valve. For example, intake mass flow increases while the intake valve is open and plateaus after the intake valve closes. Cylinder pressure, as shown in the fourth graph 660, is low while the intake valve is open.

Without combustion at the cylinder, cylinder pressure may be equal to a pressure at an intake manifold of the intake system when at least one of the intake valve and the exhaust valve is open. When the valves are both closed, however, e.g., during at least a portion of a compression stroke and an expansion stroke, the cylinder pressure increases, as shown in the fourth graph 660. As an example, the cylinder pressure may increase to a maximum of 4000 kPa. Furthermore, a net total of 0.9 grams of air may flow through the cylinder during a cycle.

A second set of graphs 700 are shown in FIG. 7, corresponding to a cam phasing provided by the first example of the camshaft assembly 300 of FIG. 3. The second set of graphs 700 are plotted relative to crank angle along the x-axis and includes a first graph 710, showing valve lift, a second graph 720 depicting cylinder volume in cubic centimeters, a third graph 740 depicting cumulative mass flow through each cylinder in grams, and a fourth graph 760 depicting cylinder pressure in kPa. The second graph 720 is similar to the second graph 620 of the first set of graphs 600 of FIG. 6.

The cam phasing may be adjusted by the phasing mechanism 328, as shown in FIG. 3, e.g., by rotating the sun gear 312 in a first direction and the ring gear 322 in a second, opposite direction. For example, with respect to the cross-sectional view of the planetary gear system 304 illustrated in FIG. 5, the sun gear 312 may be rotated in the first direction, e.g., clockwise relative to the carrier 306, causing the exhaust cams, e.g., the first and second exhaust cams 340, 342, to rotate clockwise. The ring gear 322 and intake cams, e.g., the first and second intake cams 348, 350 of FIG. 3, rotate in the second direction, e.g., counter-clockwise, but by a smaller phasing angle than the exhaust cams, as shown in the first graph 710.

The intake cams may be phased at, for example, a fixed ratio of 5:7 of the exhaust cams where the intake cams and exhaust cams are phased in opposite directions, as described above. In other words, the phasing mechanism and corresponding rotation of a carrier of the planetary gear system is configured to phase the exhaust cams and intake cams to the fixed ratio whenever the phasing mechanism is actuated. The first graph 710 includes a first plot 712, depicting an adjusted exhaust valve lift timing and a second plot 714, depicting an adjusted intake valve lift timing. The exhaust cams may be advanced relative to the nominal cam phasing by 85 degrees and the intake cams may be retarded relative to the nominal cam phasing by 60 degrees. The exhaust valve of the cylinder is therefore opened between 35 degrees and 295 degrees, for a duration of 260 degrees of crank angle, and the intake valve is opened between 405 and 640 degrees, for a duration of 235 degrees of crank angle. As such, opening of the exhaust valve and the intake valve does not overlap.

Exhaust mass flow is depicted in the third graph 740 by a first plot 742. The exhaust mass flow is depicted as negative flow, indicating initial flow out of the cylinder while the exhaust valve is opened at 35 degrees. From just after 35 degrees to 180 degrees, the piston is moving down and air is flowing into the cylinder through the exhaust valve. From 180 degrees to 295 degrees, air is flowing out of the cylinder. When the exhaust valve closes, total net exhaust mass flow approaches zero. The opening of the exhaust valve corresponds with a change in cylinder volume, as shown in the second graph 720, from low volume to high volume and returning to low volume. For example, the exhaust valve may be open during a portion of an expansion stroke and a portion of an exhaust stroke. Cylinder pressure is low while the exhaust valve is open, as shown in the fourth graph 760.

Intake mass flow is also depicted in the third graph 740, by a second plot 744. The intake mass flow increases in a positive direction while the intake valve is open, reaching a peak at a mid-point of the duration of crank angle that the intake valve is open. When the intake valve closes, intake mass flow approaches zero. The opening of the intake valve corresponds with a change in cylinder volume, as shown in the second graph 720, from low volume to high volume and returning to low volume. For example, the opening of the intake valve may occur during a portion of an intake stroke and a portion of a compression stroke. Cylinder pressure is low while the intake valve is open, as shown in the fourth graph 760.

A peak cylinder pressure of, for example, 1200 kPa, may be attained during the compression and expansion strokes of the cylinder cycle. During a period between the exhaust valve closing and the intake valve opening, e.g., between 295 and 405 degrees, cylinder pressure increases moderately, reaching a peak at a mid-point between 295 and 405 degrees and decreasing thereafter due to residual air in the cylinder. A net mass of 0.08 g of air may flow through the cylinder during a cycle, which may be a reduction to 8% of the total mass of air flowing through the cylinder when the cam phasing is nominal.

A third set of graphs 800 are shown in FIG. 8, corresponding to a cam phasing provided by the second example of the camshaft assembly 400 of FIG. 4. The third set of graphs 800 are plotted relative to crank angle along the x-axis and includes a first graph 810, showing valve lift, a second graph 820 depicting cylinder volume in cubic centimeters, a third graph 840 depicting cumulative mass flow through each cylinder in grams, and a fourth graph 860 depicting cylinder pressure in kPa. The second graph 820 is similar to the second graph 620 of the first set of graphs 600 of FIG. 6.

The cam phasing may be adjusted by the phasing mechanism 328, as shown in FIG. 4, and rotating the sun gear 312 in a first direction and the ring gear 322 in a second, opposite direction. For example, with respect to the cross-sectional view of the planetary gear system 304 illustrated in FIG. 5, the sun gear 312 may be rotated in the first direction, e.g., clockwise relative to the carrier 306, causing the intake cams, e.g., the first and second intake cams 420, 422 of FIG. 4, to rotate clockwise. The ring gear 322 and exhaust cams, e.g., the first and second exhaust cams 424, 426 of FIG. 4, rotate in the second direction, e.g., counter-clockwise but by a smaller phasing angle than the intake cams.

The intake cams may be phased at, for example, a fixed ratio of 7:5 of the exhaust cams where the intake cams and exhaust cams are phased in opposite directions, as described above. In other words, the phasing mechanism and corresponding rotation of a carrier of the planetary gear system is configured to phase the exhaust cams and intake cams to the fixed ratio whenever the phasing mechanism is actuated. The first graph 810 includes a first plot 812, depicting an adjusted exhaust valve lift timing and a second plot 814, depicting an adjusted intake valve lift timing. The exhaust cams may be advanced relative to the nominal cam phasing by 65 degrees and the intake cams may be retarded relative to the nominal cam phasing by 91 degrees. The exhaust valve of the cylinder is therefore opened between 55 degrees and 315 degrees, for a duration of 260 degrees of crank angle, and the intake valve is opened between 436 and 671 degrees, for a duration of 235 degrees of crank angle. As such, opening of the exhaust valve and the intake valve does not overlap.

Exhaust mass flow is depicted in the third graph 840 by a first plot 842. The exhaust mass flow is depicted as negative flow, e.g., the flow is initially into the cylinder while the exhaust valve is opened at 55 degrees. From just after 55 degrees to 180 degrees, the piston is moving down, and air is flowing into the cylinder through the exhaust valve. From 180 degrees to 315 degrees, air is flowing out of the cylinder. When the exhaust valve closes, exhaust mass flow is zero. The opening of the exhaust valve corresponds with a change in cylinder volume, as shown in the second graph 820, from low volume to high volume and returning to low volume. For example, the exhaust valve may be open during a portion of an expansion stroke and a portion of an exhaust stroke. Cylinder pressure is low while the exhaust valve is open, as shown in the fourth graph 860.

Intake mass flow is also depicted in the third graph 840, by a second plot 844. The intake mass flow increases in a positive direction while the intake valve is open, reaching a peak at a mid-point of the duration of crank angle that the intake valve is open. When the intake valve closes, intake mass flow is zero. The opening of the intake valve corresponds with a change in cylinder volume, as shown in the second graph 820, from low volume to high volume and returning to low volume. For example, the opening of the intake valve may occur during a portion of an intake stroke and a portion of a compression stroke. Cylinder pressure is low while the intake valve is open, as shown in the fourth graph 860.

A peak cylinder pressure of, for example, 450 kPa, may be attained during the compression and expansion strokes of the cylinder cycle. During a period between the exhaust valve closing and the intake valve opening, e.g., between 315 and 436 degrees, cylinder pressure increases, reaching a peak at a mid-point between 295 and 405 degrees due to residual air in the cylinder, where the peak corresponds to a pressure that is less than the peak cylinder pressure during the compression and expansion strokes, and decreasing thereafter. A net mass of air flowing through the cylinder during a cycle may be reduced to zero grams, e.g., no flow.

By adjusting the cam phasing to a fixed ratio of exhaust cam phasing and intake cam phasing, as shown in the second set of graphs 700 of FIG. 7 and the third set of graphs 800 of FIG. 8, air oscillates back and forth through the cylinders, resulting in zero or near-zero net flow to an exhaust system in contrast to the nominal phasing which results in a net flow out of the cylinders. Flow of air to an emission control device in the exhaust system, such as the emission control device 178 of FIG. 1, may be minimized during fuel shut-off events, thereby mitigating accumulation of oxygen at the emission control device which may otherwise lead to additional fueling to compensate. A fuel economy of the vehicle is thus increased and cooling of the catalyst is reduced due to the elimination of airflow therethrough.

The camshaft assemblies 300, 400 of FIGS. 3 and 4, respectively, enable modification of the cam phasing, e.g., relative to a drive sprocket driving rotation of the carrier, via a single actuator through execution of a single adjustment. The single adjustment alters the phasing of both the intake cam lobes and the exhaust cam lobes via a common actuator. As such phasing adjustment of the intake cam lobes and the exhaust cam lobes are dependent on one another, e.g., the intake cam lobes are not adjustable independent of the exhaust cam lobes and vice versa.

An example of a method 900 for adjusting cam phasing during a fuel shut-off event of a vehicle, such as DFSO, is shown in FIG. 9. Method 900 may be implemented at an engine of the vehicle such as engine 10 of FIG. 1 or engine 200 of FIG. 2. In particular, the engine may be a V8 pushrod engine such as engine 200 of FIG. 2. A camshaft assembly of the engine may be configured as shown in FIG. 3 or FIG. 4. As such, the camshaft assembly may have a planetary gear system coupled to a camshaft. The camshaft may be formed of two concentric portions, where an inner portion of the camshaft is coupled to a sun gear of the planetary gear system and an outer portion of the camshaft is coupled to a ring gear of the planetary gear system. Instructions for carrying out method 900 may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 902, method 900 includes estimating and/or measuring engine operating conditions. For example, engine speed may be determined by a Hall effect sensor (e.g., the Hall effect sensor 120 of FIG. 1), vehicle speed may be determined by a speedometer, mass air flow through an intake and/or exhaust system of the vehicle may be measured by mass flow sensors (e.g., the mass air flow sensor 122 of FIG. 1), and positions of each of a brake pedal and an accelerator pedal may be detected by pedal position sensors (e.g., the pedal position sensor 134 of FIG. 1). A cam phasing at the engine cylinders may be nominal, as shown in the first set of graphs 600 of FIG. 6.

The method includes determining if a fuel shut-off event is requested at 904. The fuel shut-off event request, such as DFSO, may be detected based on one or more of the vehicle speed, the position of the accelerator pedal, and the position of the brake pedal. For example, the fuel shut-off event may be initiated when the vehicle speed decreases at a threshold rate. As another example, fuel shut-off may be requested when the accelerator pedal is released and/or the brake pedal is depressed. In yet another example, the fuel shut-off event may be requested by a user via a dashboard button or switch or a human-machine interface. If the fuel shut-off event is not requested, the method continues to 906 to continue engine operation under the current conditions. The method returns to the start.

Returning to 904, if the fuel shut-off event is requested, the method proceeds to 908 to stop fueling the engine while a transmission of the vehicle is still in gear. For example, the controller may command halting of fuel injection at fuel injectors of the engine cylinders. At 910, the method includes adjusting the cam phasing from the nominal phasing by advancing exhaust cams, e.g., exhaust valve cam lobes, and retarding intake cams, e.g., intake valve cam lobes, coupled to the camshaft, as an example.

In one example, the camshaft assembly may be configured as shown in FIG. 3, with the exhaust cams coupled to the inner portion of the camshaft and the intake cams coupled to the outer portion of the camshaft. A phasing mechanism of the camshaft assembly may be actuated, rotating a sun gear relative to a carrier of the planetary gear system. A ring gear of the planetary gear system rotates relative to the sun gear and the carrier in an opposite direction from the sun gear.

This drives rotation of the inner portion and the outer portion of the camshaft in opposite directions, causing the intake cams and exhaust cams to be phased in opposite directions.

For example, rotation of the camshaft may be monitored by a camshaft position sensor which may be mounted in close proximity to the camshaft. In one example, the camshaft position sensor may utilize a magnet or an electronic signal to relay a position of the camshaft. When the sun gear is phased relative to the carrier, rotation of the camshaft may be monitored by the camshaft position sensor. The phasing mechanism may be commanded to lock the sun gear to the carrier once the camshaft has rotated through a predetermined angle relative to when the phasing mechanism was actuated. The predetermined angle may be a fixed angle that results in a target ratio of exhaust cam phasing to intake cam phasing, such as 5:7 or 7:5. For example, the exhaust cams may be advanced by 85 degrees while the intake cams may be retarded by 60 degrees relative to the nominal phasing. As a result, a net flow of air through the cylinders may be reduced to 0.08 grams.

In another example, the camshaft assembly may be configured as shown in FIG. 4, with the exhaust cams coupled to the outer portion of the camshaft and the intake cams coupled to the inner portion of the camshaft. The phasing mechanism may be actuated as described above to allow the inner portion and the outer portion to rotate in opposite directions. The exhaust cams may be advanced by 65 degrees and the intake cams may be retarded by 91 degrees. As a result, the net flow of air through the cylinder may be reduced to zero.

At 912, the method includes determining if a request for torque is indicated. The request for torque may be detected by, for example, depression of the accelerator, indicating that an increase in vehicle speed is desired. As another example, torque may be requested if the engine speed decreases to a threshold speed, such as an idle speed, below which, engine stalling may occur. In yet another example, the request for torque and termination of the fuel shut-off event may be indicated by the user via a dashboard button or switch or the human-machine interface.

If the request for torque is not detected, the method returns to 912 to determine if the request for torque is indicated. If the request for torque is indicated, the method continues to 914 to return the cam phasing to the nominal cam phasing. For example, the phasing mechanism may be actuated to phase the sun gear relative to the carrier of the planetary gear system in the opposite direction from the rotation of the sun gear described at 910. The exhaust cams and intake cams may be rotating in opposite directions until the cam phasing reaches the nominal phasing where the position of the camshaft is monitored by the camshaft position sensor. At 916, the method includes resuming fueling at the one or more deactivated cylinders, e.g., injecting fuel at the cylinders and activating spark ignition to generate torque. The method returns to the start.

FIG. 10 shows a graph 1000 depicting variations in vehicle conditions and engine operations during a fuel shut-off event. The conditions and operations shown may be occurring at a vehicle configured with a camshaft assembly as shown in FIG. 3 or FIG. 4. Time is plotted at the x-axis. Graph 1000 includes a plot 1002 illustrating an exhaust cam phasing, a plot 1004 showing an intake cam phasing, a plot 1006 depicting vehicle speed, a plot 1008 illustrating a fuel injection status, and a plot 1010 depicting a mass flow through an exhaust valve of an engine cylinder. For plots 1002 and 1004, advanced cam phasing (adv), nominal cam phasing (nom), and retarded cam phasing (ret) are represented along the y-axis. For plots 1006 and 1010, vehicle speed and mass flow increases along the y-axis, respectively. For plot 1008, the fuel injection status varies between on and off along the y-axis. In addition, plot 1006 includes a threshold speed 1012, below which a likelihood of engine stalling is increased.

Between t0 and t1, the exhaust cam phasing (plot 1002) and the intake cam phasing (plot 1004) are both nominal, e.g., phased to provide a desired amount of torque generated by fuel combustion. Vehicle speed (plot 1006) is relatively high and fuel is injected at the engine (plot 1008). Exhaust mass flow (plot 1010) is moderate through the exhaust valve.

At t1, the vehicle speed decreases at a rate that reaches a threshold change in speed. Furthermore, an accelerator pedal may be released at t1 or a brake pedal depressed. Fuel injection is turned off at one or more of the engine cylinders. The exhaust cam phasing and the intake cam phasing are adjusted by a planetary gear system of the camshaft assembly such that the exhaust cam phasing is advanced and the intake cam phasing is retarded. Mass flow through the exhaust valve decreases rapidly.

At t2, the vehicle speed decreases to the threshold speed 1012. In response, the fuel shut-off event is terminated and fuel injection is turned on at the cylinders. The exhaust cam phasing and the intake cam phasing are each adjusted to the nominal phasing, e.g., via the planetary gear system. Exhaust mass flow increases as a combination of the nominal cam phasing and fuel combustion at the cylinders results in flow of exhaust gases out of the cylinders and through an emission control device.

In this way, undesirable fuel consumption subsequent to a fuel shut-off event may be mitigated by a simple and low cost method. By adjusting a cam phasing of a camshaft assembly of an engine, a net flow through an exhaust system may be decreased during the fuel shut-off event, thereby decreasing oxygen accumulation at an emission control device in the exhaust system. The cam phasing may be adjusted by coupling a planetary gear system to a camshaft, the camshaft having two concentric portions connected to different gears of the planetary gear system. One of the concentric portions is coupled to exhaust cam lobes and the other of the concentric portions is coupled to intake cam lobes. By connecting the two portions of the camshaft to different gears, the exhaust cam lobes may be rotated in an opposite direction from the intake cam lobes, thereby modifying the cam phasing for cylinder intake and exhaust valves via a single phasing mechanism and a single adjustment. Opening of the intake and exhaust valves of the engine cylinders may be timed to generate a net flow of zero or near zero through the emission control device. As a result, excess oxygen is not stored at the emission control device and additional fueling after the fuel shut-off event ends is not demanded.

A technical effect of adjusting the cam phasing by a single actuator during the fuel shut-off event is that air flow through the exhaust system is reduced, thus decreasing oxygen accumulation at a catalyst of the emission control device and increasing a fuel economy of a vehicle. Furthermore, by reducing air flow through the exhaust system, the temperature of the catalyst is better maintained, thereby increasing conversion efficiency.

The disclosure also provides support for a method for a vehicle, comprising: adjusting a timing of an exhaust valve and a timing of an intake valve of a cylinder during a fuel shut-off event using a common actuator, the common actuator including a planetary gear system that rotates a first portion of a camshaft in a first direction and a second portion of the camshaft in a second, opposite direction, wherein the first portion and the second portion of the camshaft are concentric. In a first example of the method, adjusting the timing of the exhaust valve and the timing of the intake valve includes advancing an opening of the exhaust valve while retarding an opening of the intake valve. In a second example of the method, optionally including the first example, advancing the opening of the exhaust valve while retarding the opening of the intake valve includes retarding the opening of the intake valve by a target amount of crank angle and advancing the opening of the exhaust valve by a smaller amount of crank angle than the target amount of crank angle. In a third example of the method, optionally including the first and second examples, advancing the opening of the exhaust valve includes opening the exhaust valve early relative to a nominal timing and retarding the opening of the intake valve includes opening the intake valve late relative to the nominal timing and wherein the nominal timing is a timing of the exhaust valve and the intake valve when fuel is injected at an engine of the vehicle. In a fourth example of the method, optionally including the first through third examples, advancing the opening of the exhaust valve while retarding the opening of the intake valve includes retarding the opening of the intake valve by a target amount of crank angle and advancing the opening of the exhaust valve by a larger amount of crank angle than the target amount of crank angle. In a fifth example of the method, optionally including the first through fourth examples, advancing the opening of the exhaust valve while retarding the opening of the intake valve includes decreasing a net exhaust mass flow out of the cylinder to at least near-zero. In a sixth example of the method, optionally including the first through fifth examples, rotating the first portion of the camshaft in the first direction includes rotating a first set of cam lobes in the first direction, the first set of cam lobes coupled to the first portion of the camshaft and wherein the first portion of the camshaft is coupled to a sun gear of the planetary gear system. In a seventh example of the method, optionally including the first through sixth examples, rotating the second portion of the camshaft in the second direction includes rotating a second set of cam lobes in the second direction, the second set of cam lobes coupled to the second portion of the camshaft and wherein the second portion of the camshaft is coupled to a ring gear of the planetary gear system. In an eighth example of the method, optionally including the first through seventh examples, controlling the timing of the exhaust valve and the timing of the intake valve using the common actuator further includes rotating the sun gear relative to a carrier of the planetary gear system during the fuel shut-off event via a phasing mechanism and wherein rotating the sun gear relative to the carrier allows the first portion of the camshaft to rotate in an opposite direction from the second portion of the camshaft. In a ninth example of the method, optionally including the first through eighth examples, adjusting the timing of the exhaust valve and the timing of the intake valve using the common actuator further includes holding the sun gear fixed to the carrier after the carrier rotates through a target crank angle with the sun gear rotating relative to the carrier and wherein rotating the carrier through the target crank angle advances the timing of the exhaust valve and retards the timing of the intake valve. In a tenth example of the method, optionally including the first through ninth examples, adjusting the timing of the exhaust valve and the timing of the intake valve using the common actuator further includes reducing an amount of air flow to an emission control device of the vehicle during the fuel shut-off event by advancing the timing of the exhaust valve and retarding the timing of the intake valve. The disclosure also provides support for a method for a fuel shut-off event, comprising:

responsive to a request for cylinder deactivation, halting fuel injection at a cylinder, adjusting a phasing of both an intake valve and an exhaust valve of the cylinder from a first timing to a second timing to reduce air flow to an emission control device using a camshaft assembly actuated by a single actuator, the camshaft assembly including a camshaft with two concentric portions coupled to different gears of the actuator, responsive to a request for cylinder reactivation, adjusting the phasing of both the intake valve and the exhaust valve of the cylinder from the second timing to the first timing via the camshaft assembly, and resuming fuel injection at the cylinder. In a first example of the method, adjusting the phasing of the intake valve and exhaust valve from the first timing to the second timing includes adjusting the phasing from a timing with a period of overlap between opening the intake valve and opening the exhaust valve to a timing with no period of overlap between opening the intake valve and opening the exhaust valve and wherein the second timing includes advancing the opening of the exhaust valve and retarding the opening of the intake valve relative to the first timing. In a second example of the method, optionally including the first example, adjusting the phasing of the intake valve and the exhaust valve from the first timing to the second timing further includes reducing a net flow of air to the emission control device to at least near-zero. In a third example of the method, optionally including the first and second examples, the method further comprises: requesting cylinder deactivation when a request for a decrease in vehicle speed is indicated and requesting cylinder reactivation when an increase in vehicle speed and/or torque is indicated. In a fourth example of the method, optionally including the first through third examples, adjusting the phasing of the intake valve and exhaust valve includes rotating the two concentric portions of the camshaft in opposite directions via the actuator, the actuator including a planetary gear system and a phasing mechanism, and wherein the intake valve is coupled to a first portion of the two concentric portions and the exhaust valve is coupled to a second portion of the two concentric portions.

The disclosure also provides support for a camshaft assembly for an engine, comprising: a camshaft with a first, inner portion coupled to a first set of cam lobes and a second, outer portion coupled to a second set of cam lobes, an actuating system coupled to the camshaft and including a set of gears and a phasing mechanism, the actuating system configured to rotate the first and second portions of the camshaft in opposite directions when the phasing mechanism is activated, and a controller with computer readable instructions stored on non-transitory memory that, when executed during a fuel shut-off event, cause the controller to: adjust a phasing of the camshaft via the actuating system to reduce air flow to an exhaust system of the engine. In a first example of the system, the second portion is concentric with and circumferentially surrounds the first portion of the camshaft and wherein the first portion is connected to a sleeve via a pin extending through an opening in the second portion, the sleeve arranged concentric with and surrounding the second portion. In a second example of the system, optionally including the first example, the first set of cam lobes is arranged at the sleeve and the first portion of the camshaft is coupled to the first set of cam lobes by the connection of the sleeve to the first portion via the pin and wherein the sleeve rotates in unison with the first portion of the camshaft. In a third example of the system, optionally including the first and second examples, the engine is a pushrod engine.

In another representation, a camshaft assembly for an engine includes an actuator including a planetary gear system and a phasing mechanism, the planetary gear system including a sun gear coupled to a first, inner portion of a camshaft and a ring gear coupled to a second, outer portion of the camshaft, wherein a first set of cam lobes are fixedly coupled to the first portion of the camshaft and a second set of cam lobes are fixedly coupled to the second portion of the camshaft and phasing of the both the first and second sets of cam lobes are varied based on a single adjustment at the actuator. In a first example of the camshaft assembly, the phasing mechanism is activated to rotate the sun gear relative to a carrier of the planetary gear system when a fuel shut-off event is indicated. A second example of camshaft assembly optionally includes the first example, and further includes, wherein the fuel shut-off event is a deceleration fuel shut-off event.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

adjusting a timing of an exhaust valve and a timing of an intake valve of a cylinder during a fuel shut-off event using a common actuator, the common actuator including a planetary gear system that rotates a first portion of a camshaft in a first direction and a second portion of the camshaft in a second, opposite direction, wherein the first portion and the second portion of the camshaft are concentric.

2. The method of claim 1, wherein adjusting the timing of the exhaust valve and the timing of the intake valve includes advancing an opening of the exhaust valve while retarding an opening of the intake valve.

3. The method of claim 2, wherein advancing the opening of the exhaust valve while retarding the opening of the intake valve includes retarding the opening of the intake valve by a target amount of crank angle and advancing the opening of the exhaust valve by a smaller amount of crank angle than the target amount of crank angle.

4. The method of claim 3, wherein advancing the opening of the exhaust valve includes opening the exhaust valve early relative to a nominal timing and retarding the opening of the intake valve includes opening the intake valve late relative to the nominal timing and wherein the nominal timing is a timing of the exhaust valve and the intake valve when fuel is injected at an engine of the vehicle.

5. The method of claim 2, wherein advancing the opening of the exhaust valve while retarding the opening of the intake valve includes retarding the opening of the intake valve by a target amount of crank angle and advancing the opening of the exhaust valve by a larger amount of crank angle than the target amount of crank angle.

6. The method of claim 2, wherein advancing the opening of the exhaust valve while retarding the opening of the intake valve includes decreasing a net exhaust mass flow out of the cylinder to at least near-zero.

7. The method of claim 1, wherein rotating the first portion of the camshaft in the first direction includes rotating a first set of cam lobes in the first direction, the first set of cam lobes coupled to the first portion of the camshaft and wherein the first portion of the camshaft is coupled to a sun gear of the planetary gear system.

8. The method of claim 7, wherein rotating the second portion of the camshaft in the second direction includes rotating a second set of cam lobes in the second direction, the second set of cam lobes coupled to the second portion of the camshaft and wherein the second portion of the camshaft is coupled to a ring gear of the planetary gear system.

9. The method of claim 8, wherein controlling the timing of the exhaust valve and the timing of the intake valve using the common actuator further includes rotating the sun gear relative to a carrier of the planetary gear system during the fuel shut-off event via a phasing mechanism and wherein rotating the sun gear relative to the carrier allows the first portion of the camshaft to rotate in an opposite direction from the second portion of the camshaft.

10. The method of claim 9, wherein adjusting the timing of the exhaust valve and the timing of the intake valve using the common actuator further includes holding the sun gear fixed to the carrier after the carrier rotates through a target crank angle with the sun gear rotating relative to the carrier and wherein rotating the carrier through the target crank angle advances the timing of the exhaust valve and retards the timing of the intake valve.

11. The method of claim 10, wherein adjusting the timing of the exhaust valve and the timing of the intake valve using the common actuator further includes reducing an amount of air flow to an emission control device of the vehicle during the fuel shut-off event by advancing the timing of the exhaust valve and retarding the timing of the intake valve.

12. A method for a fuel shut-off event, comprising:

responsive to a request for cylinder deactivation;

halting fuel injection at a cylinder;

adjusting a phasing of both an intake valve and an exhaust valve of the cylinder from a first timing to a second timing to reduce air flow to an emission control device using a camshaft assembly actuated by a single actuator, the camshaft assembly including a camshaft with two concentric portions coupled to different gears of the actuator;

responsive to a request for cylinder reactivation;

adjusting the phasing of both the intake valve and the exhaust valve of the cylinder from the second timing to the first timing via the camshaft assembly; and resuming fuel injection at the cylinder.

13. The method of claim 12, wherein adjusting the phasing of the intake valve and exhaust valve from the first timing to the second timing includes adjusting the phasing from a timing with a period of overlap between opening the intake valve and opening the exhaust valve to a timing with no period of overlap between opening the intake valve and opening the exhaust valve and wherein the second timing includes advancing the opening of the exhaust valve and retarding the opening of the intake valve relative to the first timing.

14. The method of claim 13, wherein adjusting the phasing of the intake valve and the exhaust valve from the first timing to the second timing further includes reducing a net flow of air to the emission control device to at least near-zero.

15. The method of claim 12, further comprising requesting cylinder deactivation when a request for a decrease in vehicle speed is indicated and requesting cylinder reactivation when an increase in vehicle speed and/or torque is indicated.

16. The method of claim 12, wherein adjusting the phasing of the intake valve and exhaust valve includes rotating the two concentric portions of the camshaft in opposite directions via the actuator, the actuator including a planetary gear system and a phasing mechanism, and wherein the intake valve is coupled to a first portion of the two concentric portions and the exhaust valve is coupled to a second portion of the two concentric portions.

17. A camshaft assembly for an engine, comprising:

a camshaft with a first, inner portion coupled to a first set of cam lobes and a second, outer portion coupled to a second set of cam lobes;

an actuating system coupled to the camshaft and including a set of gears and a phasing mechanism, the actuating system configured to rotate the first and second portions of the camshaft in opposite directions when the phasing mechanism is activated; and a controller with computer readable instructions stored on non-transitory memory that, when executed during a fuel shut-off event, cause the controller to:

adjust a phasing of the camshaft via the actuating system to reduce air flow to an exhaust system of the engine.

18. The camshaft assembly of claim 17, wherein the second portion is concentric with and circumferentially surrounds the first portion of the camshaft and wherein the first portion is connected to a sleeve via a pin extending through an opening in the second portion, the sleeve arranged concentric with and surrounding the second portion.

19. The camshaft assembly of claim 18, wherein the first set of cam lobes is arranged at the sleeve and the first portion of the camshaft is coupled to the first set of cam lobes by the connection of the sleeve to the first portion via the pin and wherein the sleeve rotates in unison with the first portion of the camshaft.

20. The camshaft assembly of claim 17, wherein the engine is a pushrod engine.

* * * * *